US007584691B2

(12) United States Patent
Steimke et al.

(10) Patent No.: US 7,584,691 B2
(45) Date of Patent: Sep. 8, 2009

(54) SELF-POWERED IMPULSE AVERAGING RECOIL OPERATED MACHINE GUN WITH A ROTARY LOCK BOLT DRIVEN BY BIMODAL CAMS

(75) Inventors: David L. Steimke, Burlington, VT (US); Parke R. Warner, Colchester, VT (US)

(73) Assignee: General Dynamics Armament and Technical Products, Burlington, VT (US)

( * ) Notice: Subject to any disclaimer, the term of this patent is extended or adjusted under 35 U.S.C. 154(b) by 323 days.

(21) Appl. No.: 11/531,340

(22) Filed: Sep. 13, 2006

(65) Prior Publication Data

US 2008/0236379 A1 Oct. 2, 2008

Related U.S. Application Data

(60) Provisional application No. 60/821,310, filed on Aug. 3, 2006.

(51) Int. Cl.
*F41A 19/31* (2006.01)

(52) U.S. Cl. ..... 89/132; 89/17; 89/4.2; 42/16

(58) Field of Classification Search ..... 89/132, 89/17, 4.2; 42/16
See application file for complete search history.

(56) References Cited

U.S. PATENT DOCUMENTS 3,071,043 A 1/1963 McThomas
3,630,118 A * 12/1971 Stoner ..... 89/13.05
3,650,175 A * 3/1972 Colby ..... 89/33.25
3,680,432 A * 8/1972 Rocha ..... 89/33.04
3,955,470 A * 5/1976 Kruzell ..... 89/185
3,996,685 A * 12/1976 Bauman et al. ..... 42/17
4,043,250 A 8/1977 Wiese
4,308,785 A * 1/1982 Samuel ..... 89/4.2
4,398,448 A * 8/1983 LaFever ..... 89/185
4,579,034 A * 4/1986 Holloway ..... 89/33.1
4,672,880 A * 6/1987 Bohler ..... 89/12
4,700,608 A * 10/1987 Pettinga et al. ..... 89/11
4,920,855 A * 5/1990 Waters ..... 89/172
4,942,802 A * 7/1990 Stoner ..... 89/191.01
5,155,292 A * 10/1992 Rostcil et al. ..... 89/167
5,227,578 A * 7/1993 Reynolds ..... 89/186
5,383,389 A * 1/1995 Wolff et al. ..... 89/33.04
5,551,179 A * 9/1996 Young ..... 42/16
5,770,814 A * 6/1998 Ealovega ..... 89/131
5,900,577 A 5/1999 Robinson et al.
6,343,536 B1 2/2002 Rossier et al.
7,213,498 B1 * 5/2007 Davies ..... 89/198
7,316,091 B1 * 1/2008 Desomma ..... 42/16
2004/0069138 A1 * 4/2004 Jebsen et al. ..... 89/198

* cited by examiner

*Primary Examiner*—Michelle Clement
(74) *Attorney, Agent, or Firm*—Hunton & Williams

(57) ABSTRACT

A weapon system is provided with a rotary lock bolt driven by a bimodal cam way.

7 Claims, 32 Drawing Sheets

SELF-POWERED IMPULSE AVERAGING RECOIL OPERATED MACHINE GUN WITH A ROTARY LOCK BOLT DRIVEN BY BIMODAL CAMS

The present application claims priority to provisional application 60/821,310, filed on Aug. 3, 2006, which is incorporated herein by reference in its entirety.

GOVERNMENT LICENSE RIGHTS

The U.S. Government has a paid-up license in this invention and the right in limited circumstances to require the patent owner to license others on reasonable terms as provided for by the terms of W15QKN-04-C-1093 awarded by the Department of Defense.

FIELD OF THE INVENTION

Embodiments of the invention relate to an automatic weapon. More specifically, embodiments of the invention relate to a recoil operated automatic weapon with a rotary lock bolt.

BACKGROUND OF THE INVENTION

Throughout history, military forces have been employed in offensive, defensive, and peace-keeping roles. In all roles, these military forces have required the use of weapons, and more particularly, firearm weapons. The present invention is directed to a machine gun with a rotary lock bolt driven by bimodal cams.

SUMMARY OF THE INVENTION

One aspect of the present invention provides a weapon system comprising a receiver having at least one side plate with a bimodal cam way formed therein. The bimodal cam has an upper surface and a lower surface. A barrel extension is provided with at least a first end and at least one side plate with a cam way formed into the at least one side. A barrel is provided with a longitudinal axis and mounted to the barrel extension first end. A spring and buffer assembly is provided with a first end and a second end, wherein the first end is mounted to the barrel extension and the second end is mounted to the receiver. The mounted spring and buffer assembly are generally parallel to the barrel longitudinal axis. A bolt carriage is provided with a first end, a second end and at least one side plate, and a carriage cam way formed in the side plate. The weapon system further comprises a firing pin assembly fixed to the bolt carriage and having a bolt cam way. A rotary lock bolt having a first end, a second end, and a hollow pass-through is provided with the first end comprises a generally flat forward facing surface and a plurality of lugs radially arranged about the forward facing surface. The hollow pass-through extends through both first and second ends, and is shaped to telescopically receive the firing pin assembly. A bolt cam pin is adapted to be fixedly attached to the rotary lock bolt and simultaneously capable of sliding in and along the firing pin assembly bolt cam way. The relative movement of the bolt cam pin is relative movement along the longitudinal axis between the firing pin assembly and the rotary lock bolt causes the rotary lock bolt to rotate about the longitudinal axis due to the bolt cam pin riding in the bolt cam way. A toggle assembly having a toggle arm, a carriage cam way roller that rides in the carriage cam way, a barrel extension cam way roller that rides in the barrel extension cam way, and a receiver bimodal cam way roller to ride in the receiver bimodal cam way, the carriage cam way roller, barrel extension cam way roller and receiver cam way roller being collinear. The receiver roller rides on at least a portion of the bimodal cam way upper surface during a forward stroke of a firing cycle of the weapon system, and the receiver roller rides on at least a portion of the bimodal cam way lower surface during a rearward recoil stroke of a firing cycle of the weapon system.

BRIEF DESCRIPTION OF THE FIGURES

The accompanying drawings, which are incorporated in and constitute a part of this specification, illustrate embodiments of the invention and, together with the description, serve to explain the principles of the invention.

DESCRIPTION OF THE PREFERRED EMBODIMENTS

The following description is intended to convey a thorough understanding of the invention by providing a number of specific embodiments and details involving an automatic weapon system 100. It is understood, however, that the invention is not limited to these specific embodiments and details, which are exemplary only. It is further understood that one possessing ordinary skill in the art, in light of known systems and methods, would appreciate the use of the invention for its intended purposes and benefits in any number of alternative embodiments. Throughout the specification, the use of the terms "front" or "forward" refer to or toward the weapon system muzzle, and the terms "rear" or "rearward" refer to or toward the end of the weapon system 100 opposite the muzzle.

Figure 1A:
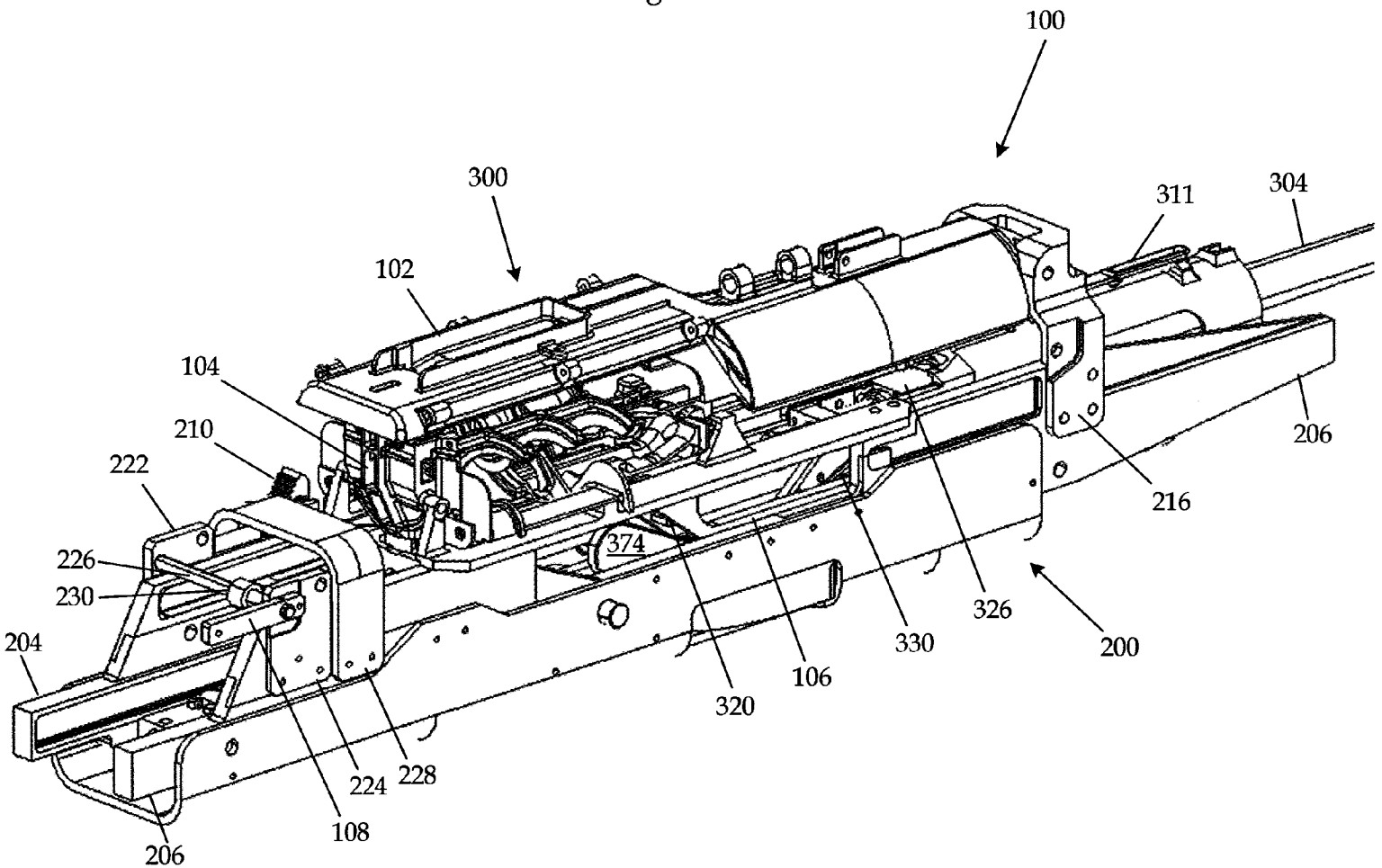
FIG. 1A is a preferred embodiment of the present invention shown in a perspective view from the right and rear of the invention.
Figure 1B:
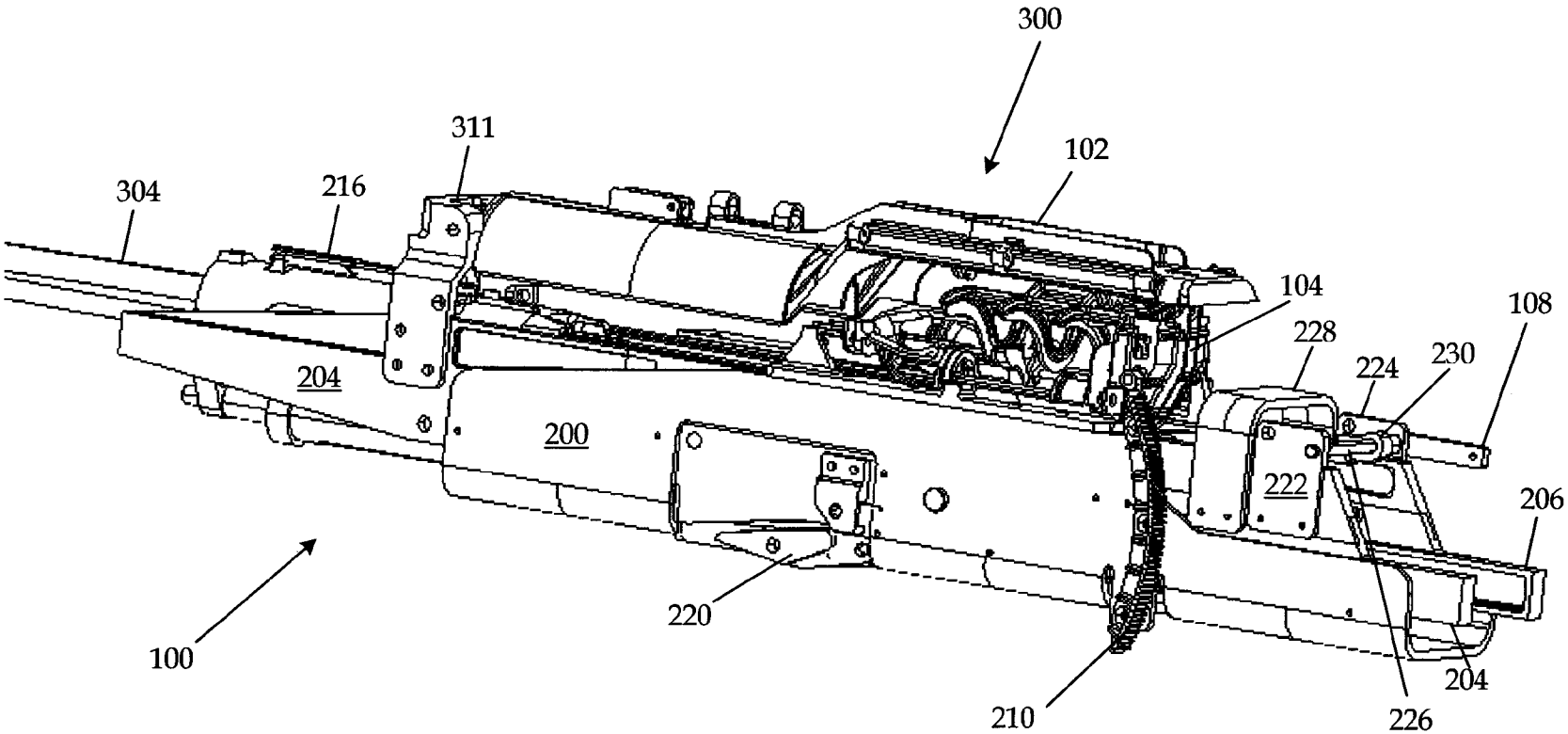
FIG. 1B is a preferred embodiment of the present invention shown in a perspective view from the left and rear of the invention.

Referring to FIGS. 1A and 1B, a recoil operated gun system 100 is provided as an exemplary embodiment of the invention. The gun system 100 of the preferred embodiment comprises a receiver 200 and an operating group 300. The gun system 100 comprises a feeder 102, a cartridge guide 104, an eject port 106, and a trigger 108. These components are generally known in the art.

Figure 2:
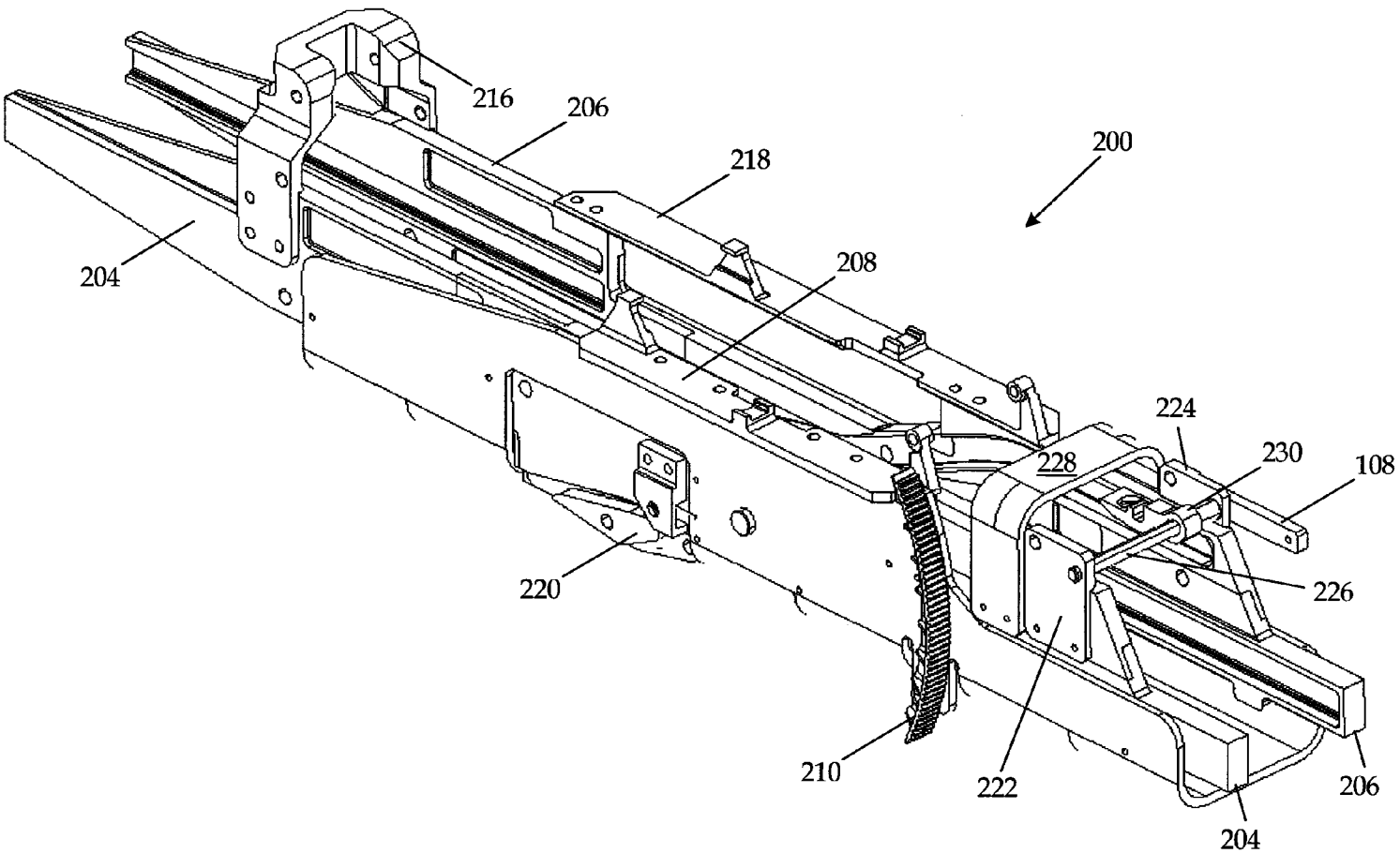
FIG. 2 is a perspective view the receiver of the present invention.
Figure 3:
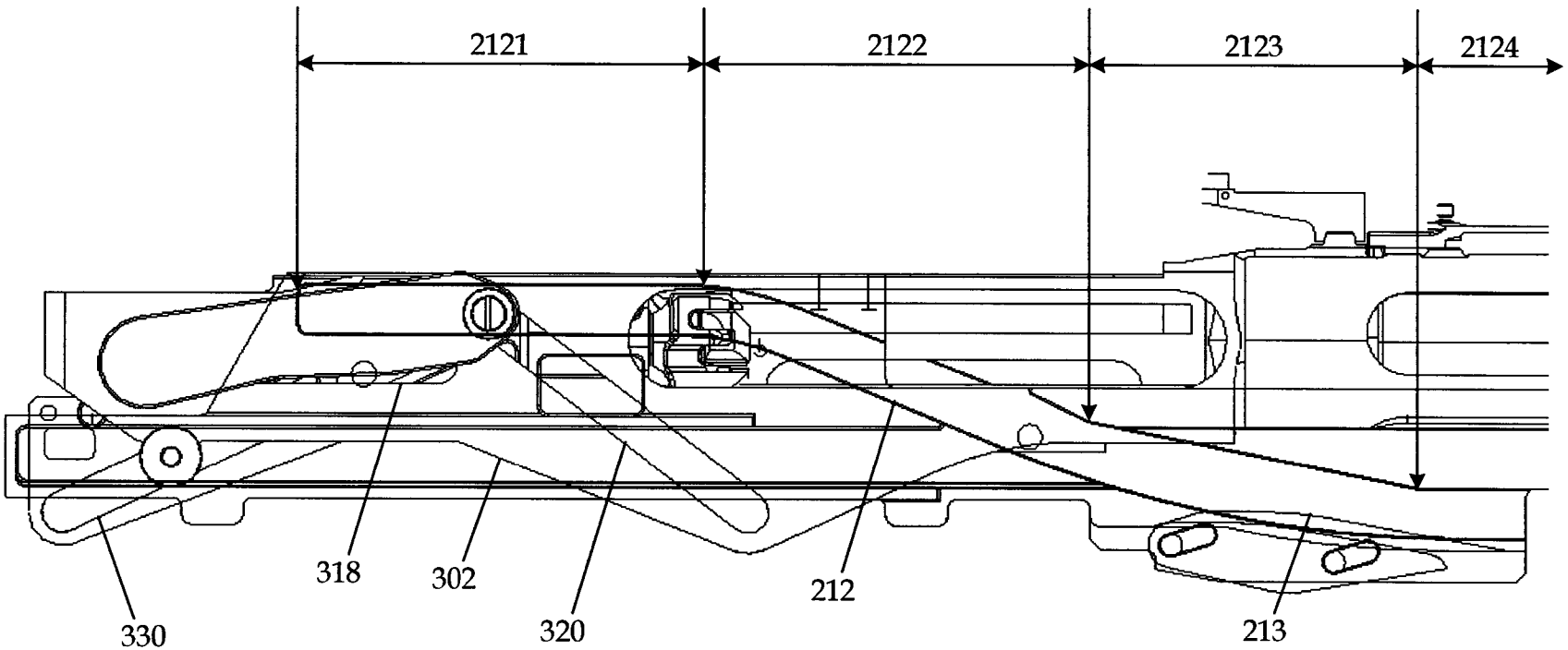
FIG. 3 illustrates a side view of the bimodal cam of the present invention.
Figure 4:
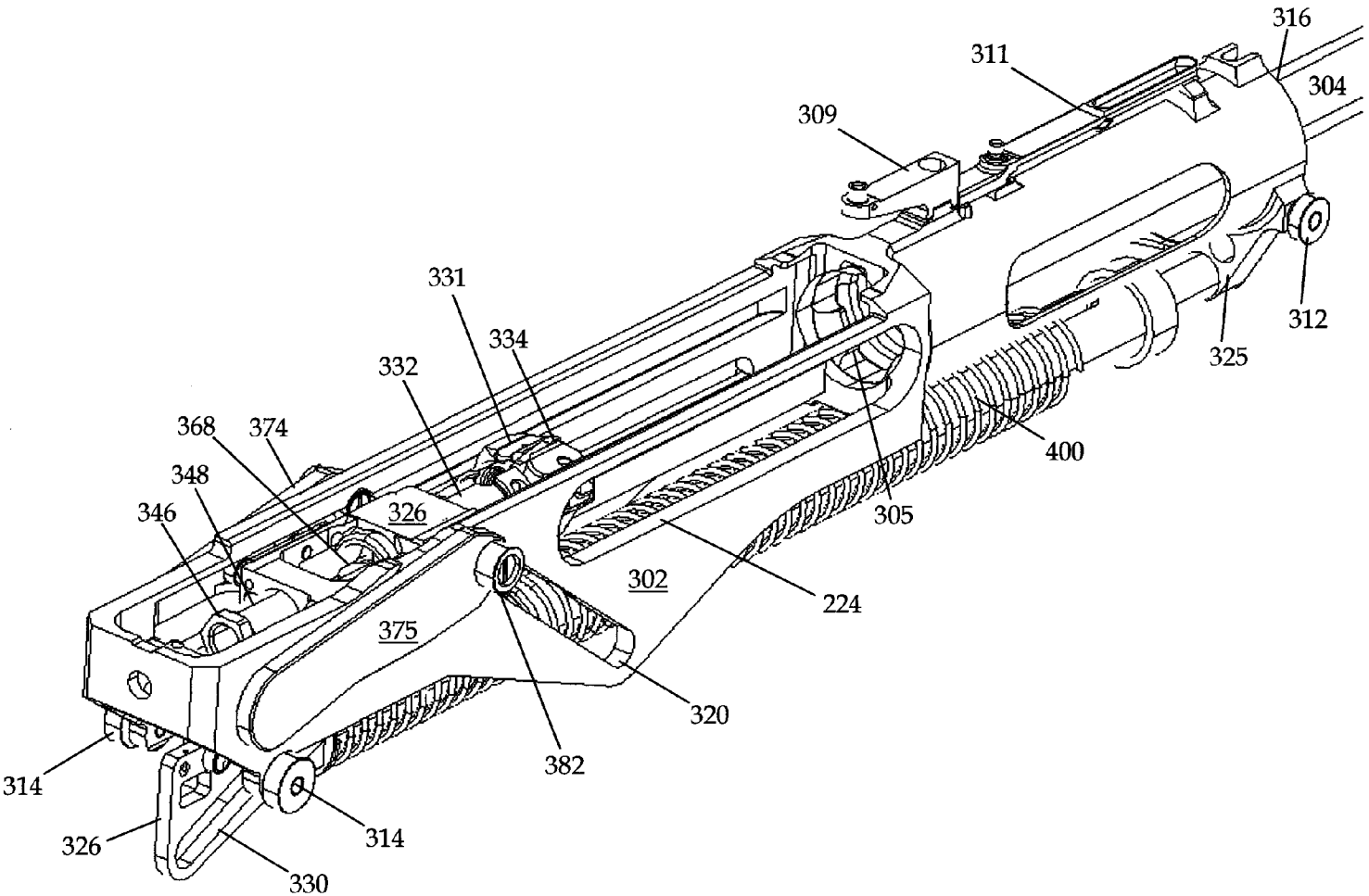
FIG. 4 depicts the operating group of the present invention.

Referring now to FIGS. 2 and 3, the receiver 200 is adapted to at least partially house the internal operating group 300 (see FIGS. 1A, 1B, and 4). The receiver 200 comprises a longitudinal generally U-shaped cradle 202 having a horizontal member and two parallel vertical sidewalls. The cradle 202 is a mounting platform for parallel left 204 and right 206 side plates. The two side plates 204, 206 are mounted on the vertical sidewalls of the cradle 202. The cradle 202 further provides a mounting surface for a left cartridge guide mount 208 on the left side of the weapon 100, and a sector gear 210. The sector gear 210 interfaces with a pintle (not shown) to allow for precise control over the elevation or depression of the weapon system, such sector gears are generally known in the art.

A bimodal cam way 212 is formed in each side plate 204, 206. The two bimodal cam ways 212 are parallel to each other. Each side plate 204, 206 further comprise barrel extension rails 214 to guide the movement of the barrel extension 302 and toggles of the operating group 300, these features are discussed in greater detail herein. The side plates 204, 206 also comprise mounting surfaces for a forward feeder mount 216 for mounting the ammunition feeder 102. The left side plate 204 supports an active firing cam 220, and the right side plate supports a right cartridge guide mount 218. The active firing cam 220 is spring-loaded and biases the receiver rollers 382 to the upper surface of the bimodal cam way 212. The left and right cartridge guide mounts 208, 218 provide a platform to mount the cartridge guide 104 (see FIGS. 1A-1B). Together, the side plates 204, 206 comprise mounting surfaces for left 222 and right 224 sear mounting plates for mounting a sear 226, and mounting surfaces for mounting a rear side plate support 228. Both the sear 226 and rear side plate support 228 are mounted transverse to the longitudinal axis of the cradle 202. The right sear mounting plate 224 also supports the trigger 108 and trigger axial (not shown) which extends transversely across to the left 222 sear mounting through holes in plate.

Referring to FIG. 3, the bimodal cam way 212 can generally be described as having an upper flat portion, a sloped portion, and a lower portion. An active cam gate 213 is attached to the receiver below the lower portion of the bimodal cam 212. The cam gate 213 is spring loaded to be biased toward the top of the slots in the cam plates. The cam way 212 further has upper and lower surfaces. The function and use of the cam way 212 and its sections are discussed herein with respect to the weapon system operating cycle.

Figure 5:
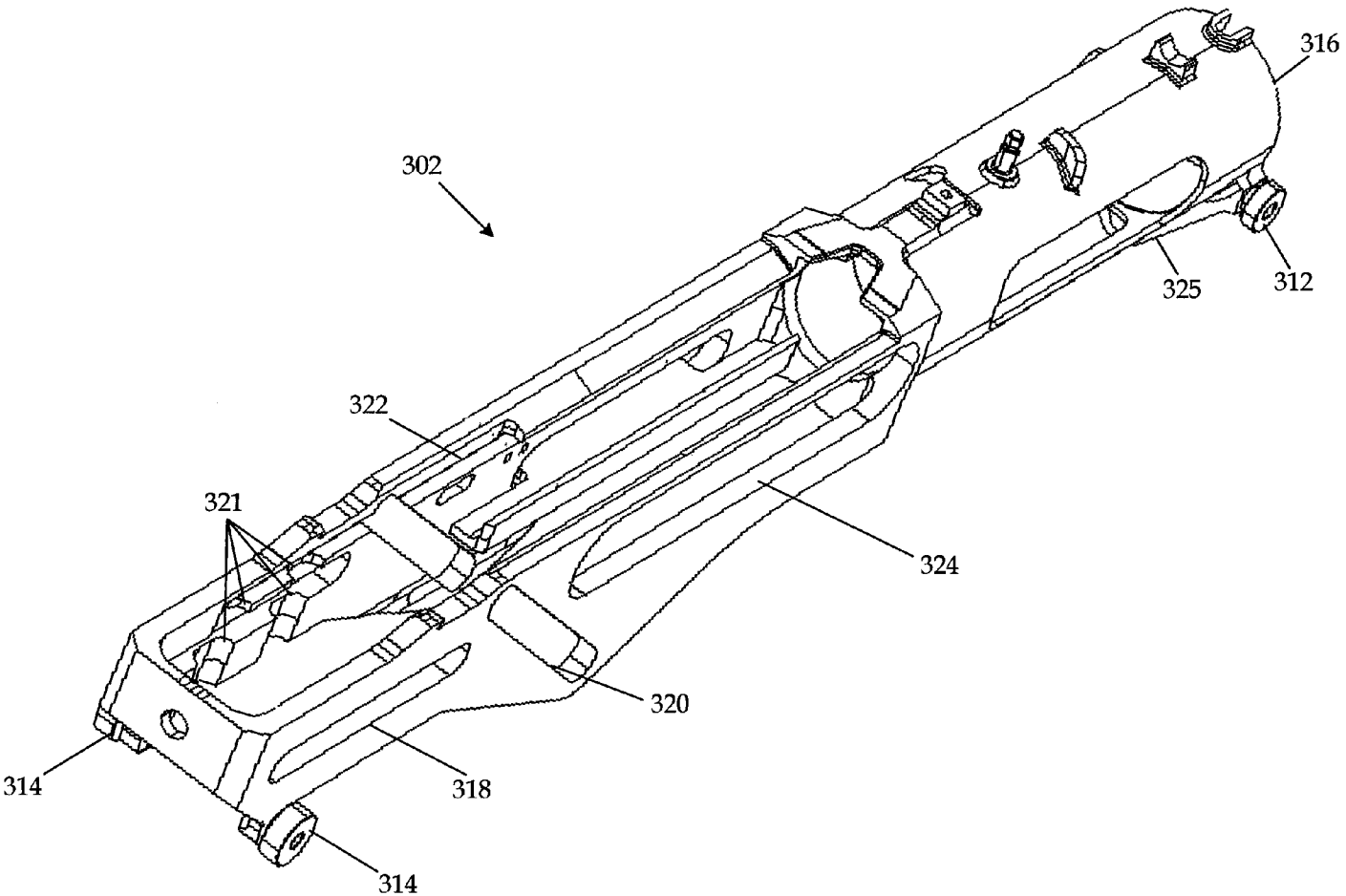
FIG. 5 is a perspective view of the barrel extension of the present invention.
Figure 6:
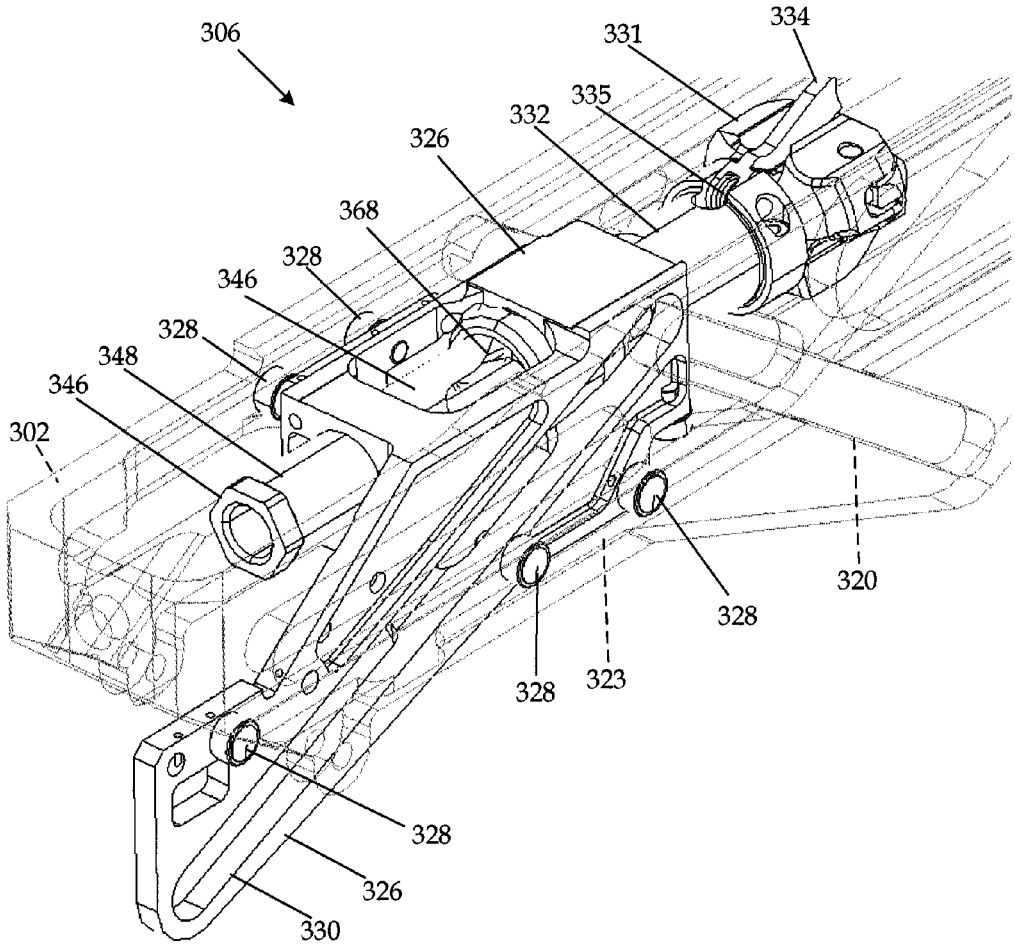
FIG. 6 is a perspective view of the rotary lock bolt assembly of the present invention.
Figure 7A:
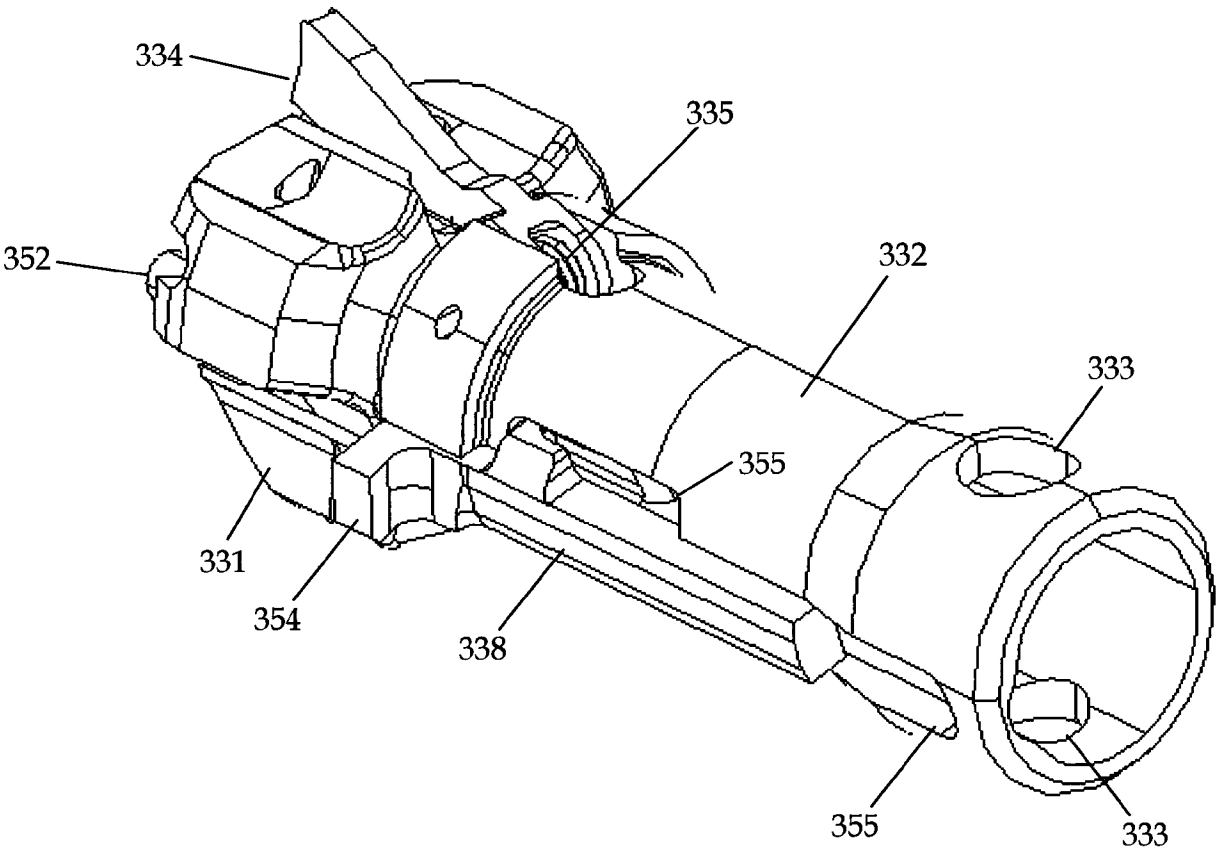
FIG. 7A illustrates the rotary lock bolt of the present invention.
Figure 7B:
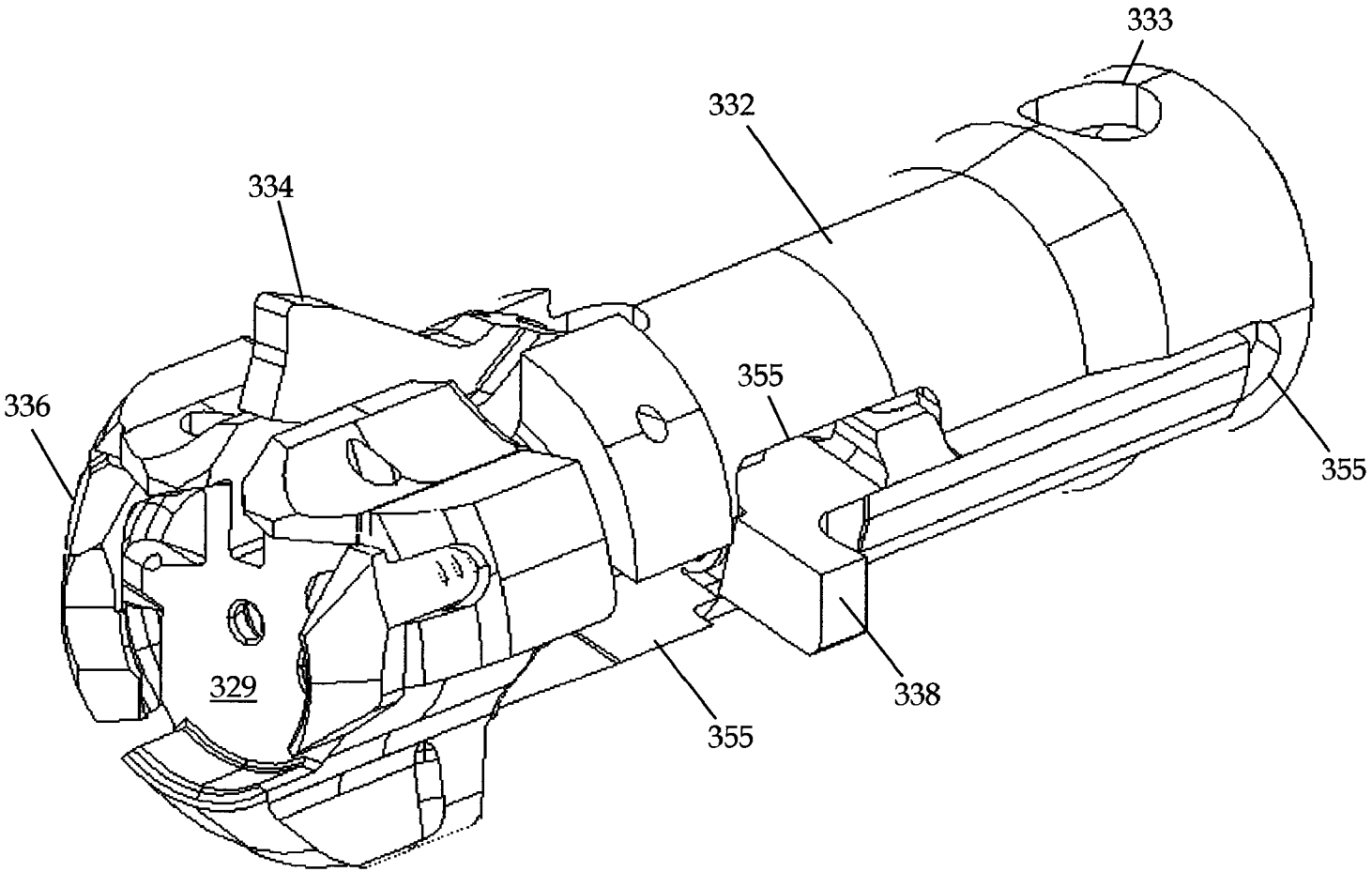
FIG. 7B shows the components used in conjunction with the rotary lock bolt of the present invention.
Figure 7D:
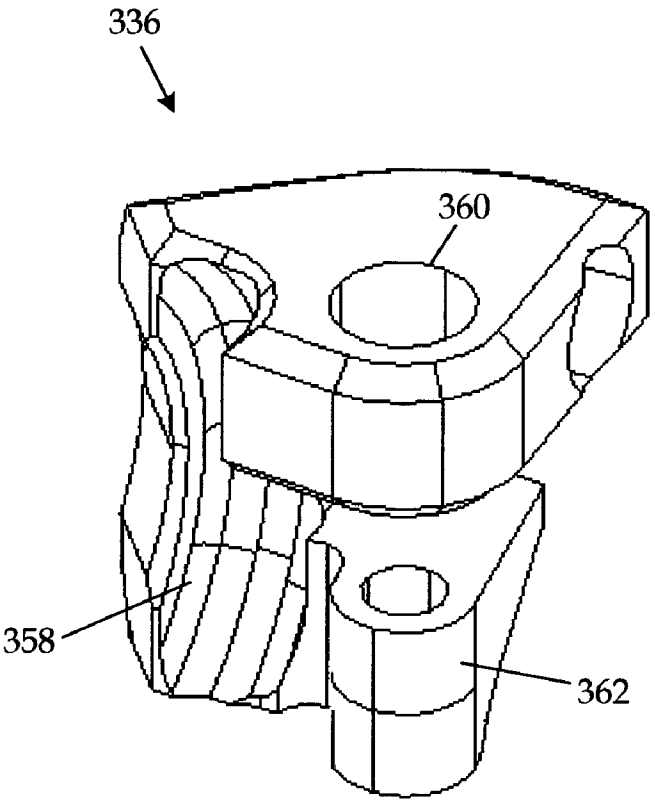
FIG. 7D is a side view of the round retainer of the present invention.
Figure 7C:
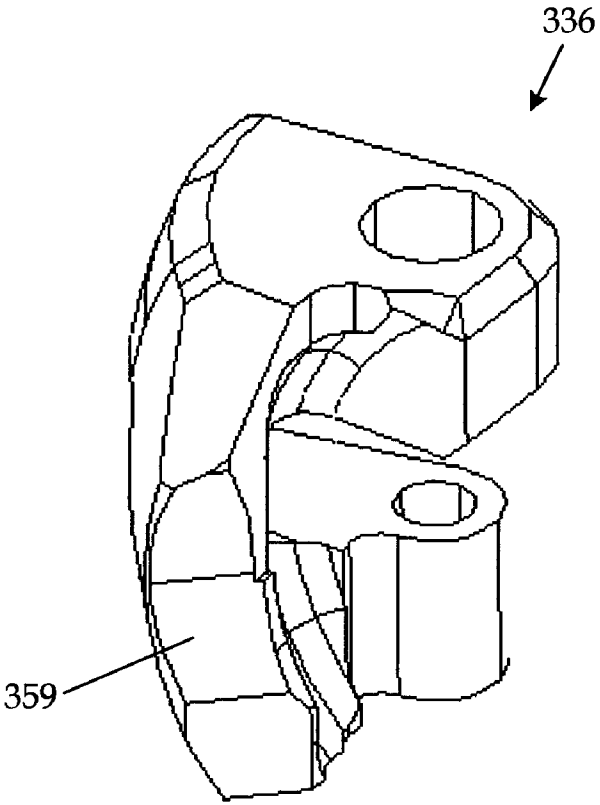
FIG. 7C depicts the round ejector of the present invention.
Figure 7E:
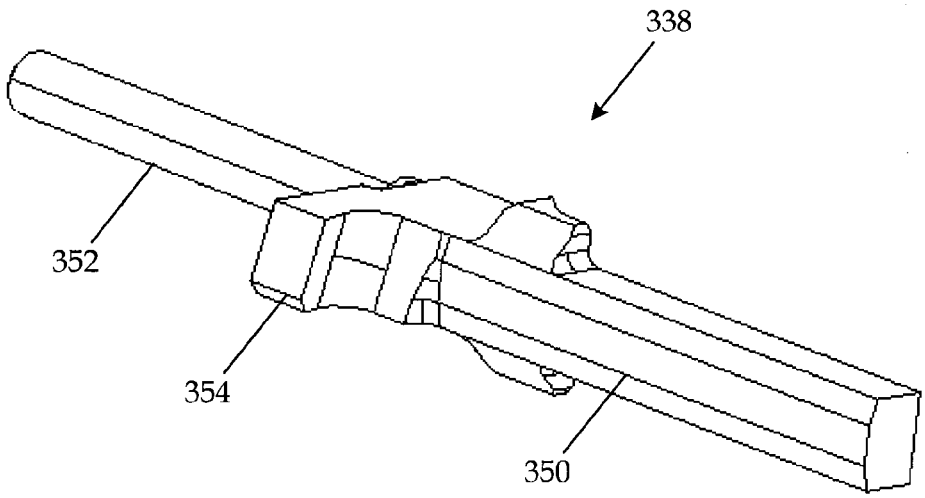
FIG. 7E illustrates the ejector of the present invention.
Figure 7F:
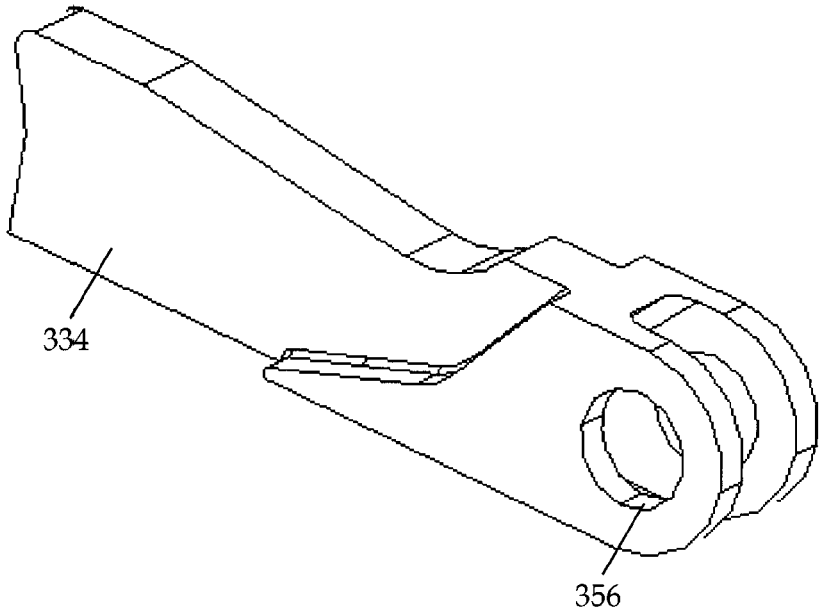
FIG. 7F illustrates the round rammer of the present invention.
Figure 8A:
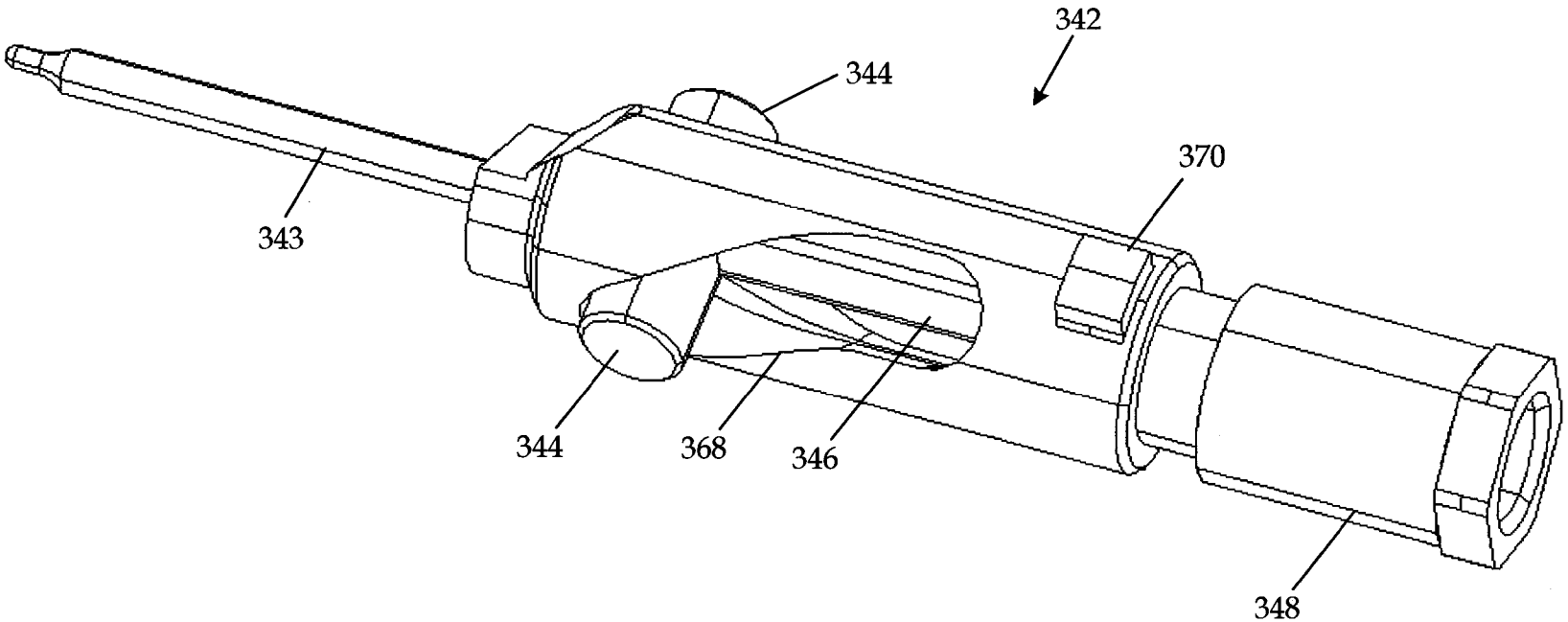
FIG. 8A illustrates the firing pin assembly of the present invention.
Figure 8B:
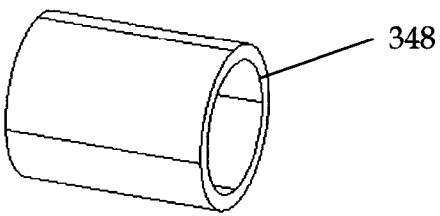
FIG. 8B shows the extraction buffer of the present invention.
Figure 8C:
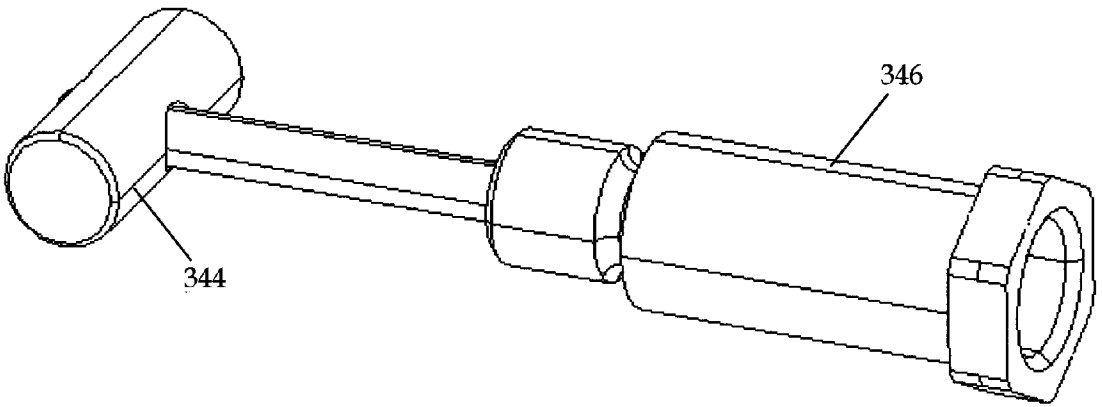
FIG. 8C depicts the cam pin and cam pin retainer of the present invention.
Figure 8D:
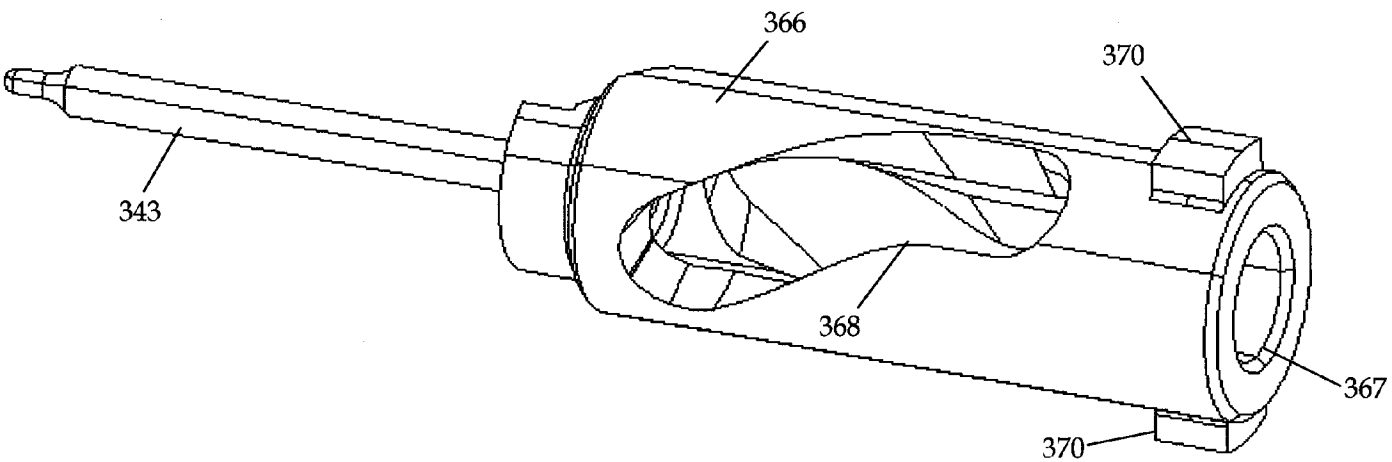
FIG. 8D illustrates the firing pin of the present invention.

With reference to FIG. 4, the operating group 300 comprises a barrel extension 302, a barrel 304, a chamber 305, a bolt assembly 306, a toggle assembly 308, a detachable feed post 309, an impulse averaging buffer assembly 400, and a barrel lock 311. Referring now to FIG. 5, the barrel extension 302 comprises two forward 312 (one not shown) and two rear 314 bearings to guide the barrel extension 302 along the length of the side plates 204, 206, a forward barrel opening 316, toggle track openings 318 on either side, barrel extension cam ways 320 on either side, carriage extractor slots 321, an ejector post slot 322, a carriage rail 323, an eject window 324, and a buffer mount 325. The barrel 304 is preferably manufactured from Cr—Mo steel with a chromium-plated bore. However, the barrel 304 could be manufactured of other materials known in the art. The barrel 304 is also preferably .50 caliber and has a twist ratio of 1 turn per 9 inches of barrel length. The barrel may also be provided with a quick release feature, such as by rotating the barrel lock counter-clockwise until the lock clears the barrel then pull the barrel forward through the barrel extension opening.

Referring now to FIGS. 6-9, the bolt assembly 306 comprises a carriage 326 with 4 bearings 328 and a cam way 330, a rotary lock bolt 332 with a rammer 334, rammer spring 335, a round extractor 336, a round retainer spring (not shown), an ejector 338 in the bolt 332, and an ejector spring 340 and a fixed firing pin assembly 342.

Referring now to FIGS. 7A-7F, the rotary lock bolt 332 has a generally cylindrical body with a face on a forward surface. The face of the bolt 332 closes the rear of the chamber 305 during firing of the weapon system 100. A hollow cylinder runs the length of the bolt 332 to telescopically receive the firing pin assembly 342. The cylinder extends the entire length of the bolt 332 to allow the firing pin 343 to extend forward of the bolt head 331 and into the chamber 305 to impact the primer during firing of the weapon system 100.

The round ejector 338 lies generally parallel with the axis of the barrel 304 and comprises a body 350, a longitudinal finger 352, and an ejector stop post 354. The ejector finger 352 extends through and beyond the face of the bolt 332. The ejector stop post 354 is formed at the base of the finger 352, and the ejector body 350 is formed rearward of the post 354. The body 350 is elongated and generally flat, it rides in a groove along the left circumferential side of the bolt 332. The ejector spring 340 is circumferentially arranged about the finger 352 and is compressed between the bolt and the stop post 354, biasing the finger 352 rearward keeping the finger clear of the forward surface of the bolt head 331.

The round rammer 334 is mounted in a groove formed in the top circumferential side of the bolt 332. A pin (not shown) extends through an opening 333 in the bolt 332 and through the rammer pivot 356. The rammer 334 is mounted to the bolt 332 so as to pivot about an axis that is perpendicular to the bolt axis and along a vertical plane. The rammer torsion spring 335 biases the rammer 334 in an up-pivoting position.

The round extractor 336 comprises a claw-like edge 357, a pivot 360, and a hole 362. The round extractor 336 is mounted in a groove formed in the face of the bolt 332. A pin (not shown) extends through an opening 337 in the bolt 332 and through the extractor pivot 360. The extractor 336 is mounted to the bolt 332 so as to pivot about an axis that is perpendicular to the bolt axis. A compression retainer spring (not shown) biases the extractor 336 so that it pivots in toward the bolt face 329. The claw-like edge 357 facilitates gripping a cartridge 110 when it pivots into the bolt face 329. The pivot 360 is inboard of the claw-like edge 357 thereby providing a moment about the pivot 360 to close the claw-like edge 357 against the round 110 if it pulls away from the bolt face 329. The face of the claw-like edge 357 has an angled surface 359 thereby allowing the round extractor 336 to be forced open when a round 110 is pushed toward the bolt face 329, allowing the round 110 into the bolt face 329.

With reference now to FIGS. 8A-8D, the firing pin assembly 342 comprises a firing pin 343, a bolt cam pin 344, a cam pin retainer 346, and an extraction buffer 348. The firing pin 343 extends from a forward surface of a firing pin body 366. The firing pin body 366 comprises a hollow cylinder with two helix bolt cams 368 in which the bolt cam pin 344 rides and a cylindrical rear opening 367. The bolt cams 368 are openings in the circumferential surface of the firing pin body 366 with a width slightly wider than the circumference of the bolt cam pin 344. The forward end of the cams 368 generally follow helical path generally 30° relative to a longitudinal axis of the firing pin body 366. The rearward end of the cams 368, however are generally parallel to the same longitudinal axis. The firing pin body 366 comprises torsion restraining lugs 370. The firing pin body 366 further comprises threads at the rearward end of the opening 367 to threadedly secure the cam pin retainer 346.

The cam pin retainer 346 comprises a cylindrical body 349 with lug 351 attached at the rear. A cam pin retainer shaft 347 extends from a forward surface of the cam pin retainer body 349 to retain the cam pin 344 in the bolt cams 368 by extending into an opening in the circumferential side of the cam pin 344. The cam pin 344 is free to slide and rotate about the cam pin retainer shaft 347. The cam pin retainer 346 forward end is threadedly received within the firing pin rear opening 367 so that the shaft 347 extends into the firing pin body 366 and the cam pin 344 is free to slide through the twisting bolt cams 368. An extraction buffer 348 is retained on the cam pin retainer body 349 between the firing pin body 366 and the lug 351.

Figure 9A:
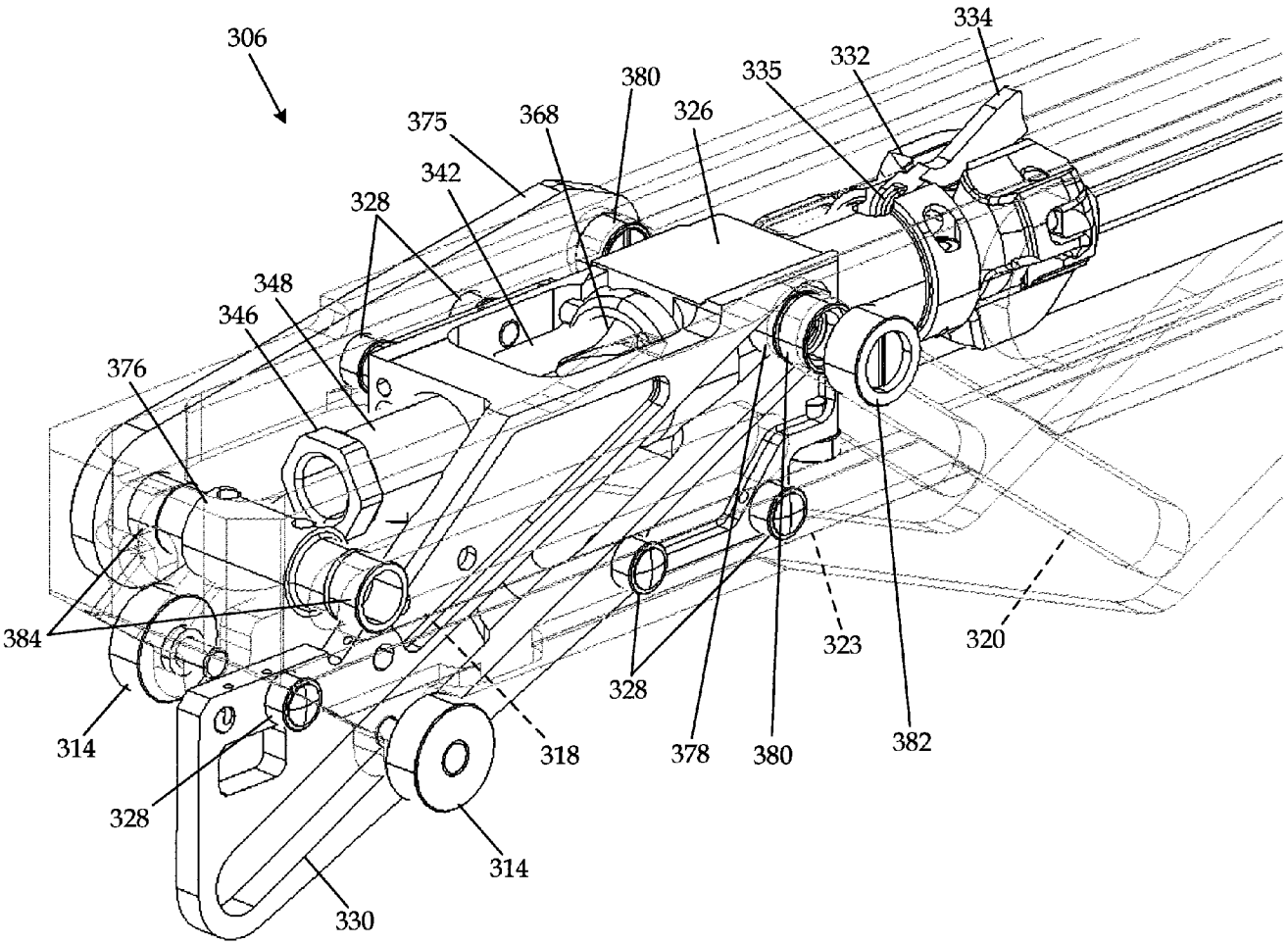
FIG. 9 depicts the rotary lock bolt assembly installed in the carriage.
Figure 9B:
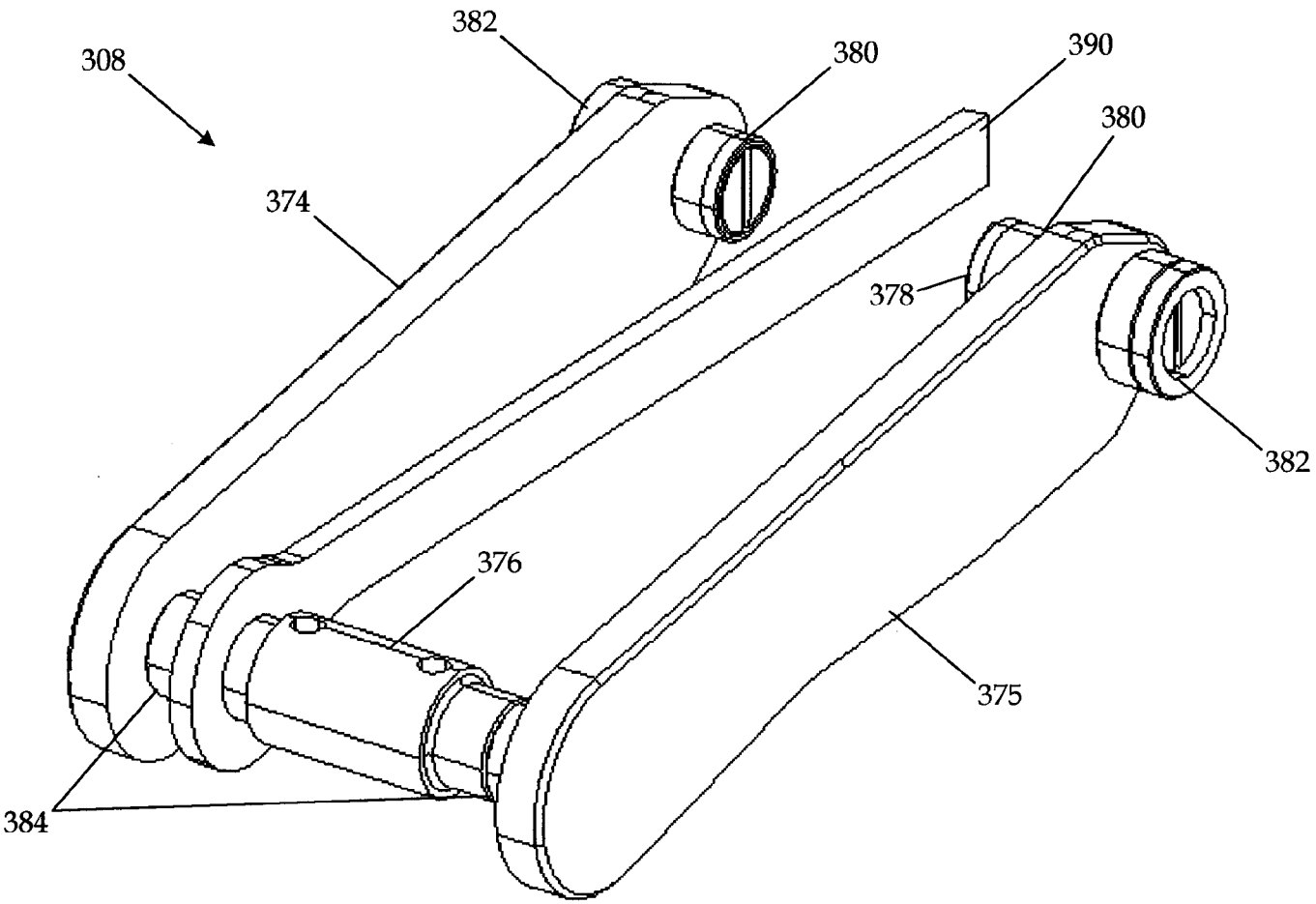

Referring now to FIGS. 4 and 9, the forward end of the carriage 326 comprises a bolt opening 364 to telescopically receive both the firing pin 343 and the bolt 332. The torsion restraining lugs 370 fit in recesses at the rear end of the carriage 326 to prevent the firing pin 343 from rotating about the axis of the bolt 332. The bolt 332 is then inserted into the opening 364 and the cam pin 344 is inserted through the cam pin openings 333 and the bolt cams 368. The cam pin retainer 346, with the extraction buffer 348 already attached, is then inserted into a retainer opening 372 at the rear of the carriage 326 and threaded into the firing pin rear opening 367. The firing pin 343 is now axially fixed to the carriage 326. The carriage 326 holds the firing pin 343 and bolt 332 collinear. The bolt 332 is now able to slide along the length of the firing pin 343 and rotate about the firing pin 343, following the bolt cams 368 through the cam pin 344. The carriage 332 is inserted into the barrel extension 302 through the carriage extraction slots 321. The barrel extension 302 now retains the firing pin 343, bolt 332, chamber 305, and barrel 304 collinear. The bolt cam pin 344 rides in the bolt cams 368 thereby defining both the rotational and axial position of the bolt 332. A bolt lug is restrained from rotation by a bolt side rail (not shown) in the barrel extension 302 thereby retaining the bolt 332 and bolt face 329 forward of the firing pin during the first half of the firing cycle.

The toggle assembly 308 comprises left 374 and right 375 toggles, a toggle shaft 376, a carriage roller 378, barrel extension rollers 380, a receiver roller 382, and rear rollers 384. The toggle shaft 376 connects the two toggles 374, 375. A rear roller 384 is positioned between the shaft 376 and each toggle 374, 375 and allows the toggle assembly 308 to ride in the toggle track openings 318 on the barrel extension 302. The left toggle 374 extends forward and connects to a barrel extension roller 380. The right toggle 375 extends forward parallel to the left toggle 374. The right toggle 375 is attached to a collinear stack of rollers, the carriage roller 378, a barrel extension roller 380, and the receiver roller 382. The carriage roller 378 rides in the carriage cam way 330, the barrel extension rollers 380 ride in the barrel extension cam ways 320, and the receiver roller 382 rides in the receiver's bimodal cam way 212. Because these rollers are collinear, the carriage cam way, the barrel extension cam way 320 and the bimodal cam way 212 will always share an intersecting point. These rollers and cams work together to adjust the position and speed of the carriage 326 relative to the barrel extension 302 as the barrel extension 302 moves through the receiver 200 during the operating cycle. An ejector bar 390 is attached to the side of and is collinear with and free to rotate about the toggle shaft 376. The front of the ejector bar 390 is supported by a groove in the ejector 338 and the front of the ejector bar 390 rests on the ejector post 354 pushing the round ejector 338 forward.

Embodiments of the recoil system are described in U.S. Pat. No. 6,343,536 which is hereby incorporated by reference.

With reference to FIGS. 10A-17, the cycle of the weapon system 100 will now be discussed in detail. With the weapon 100 in a neutral position, the operator first charges the weapon 100, as is known in the art.

Figure 10A:
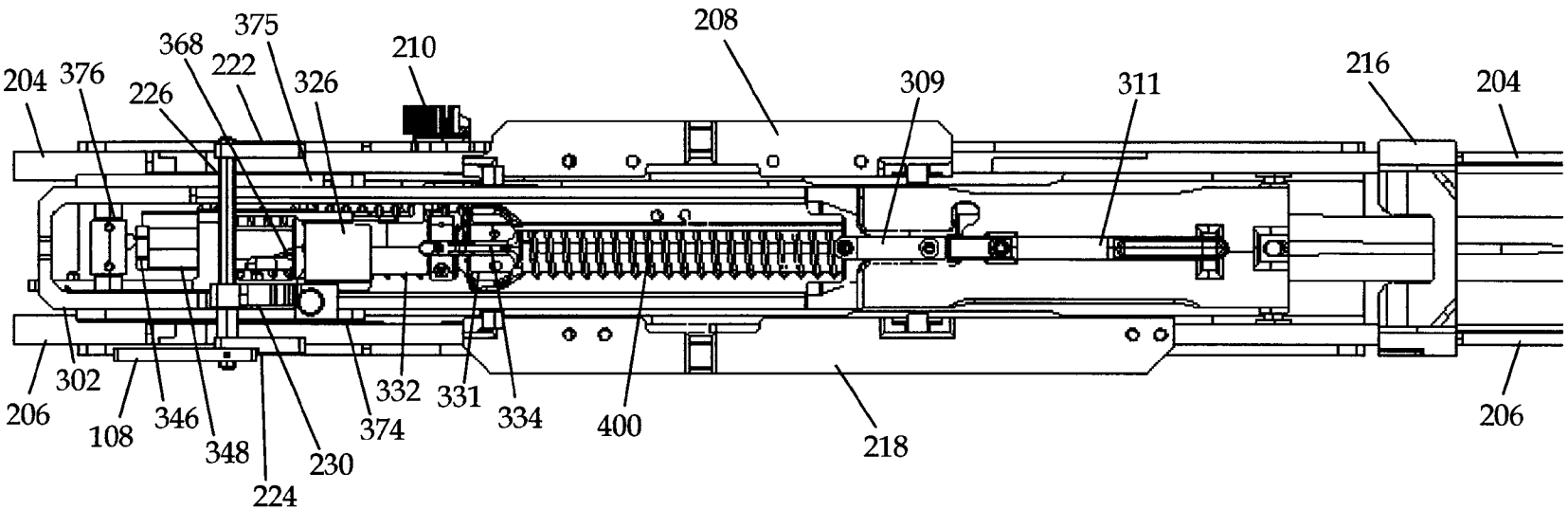
FIG. 10A is a top view of the operating group in the sear position.
Figure 10B:
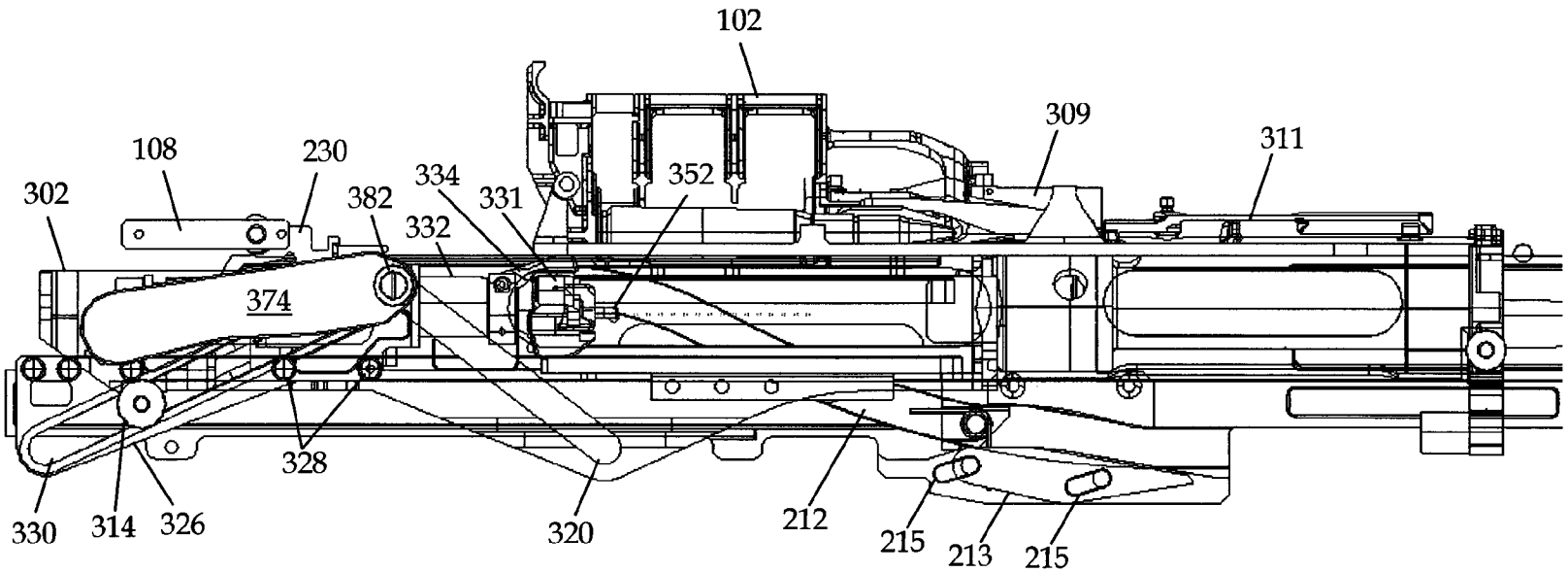
FIG. 10B is a cross-sectional view of the present invention showing the position of the rollers in the sear position.
Figure 10C:
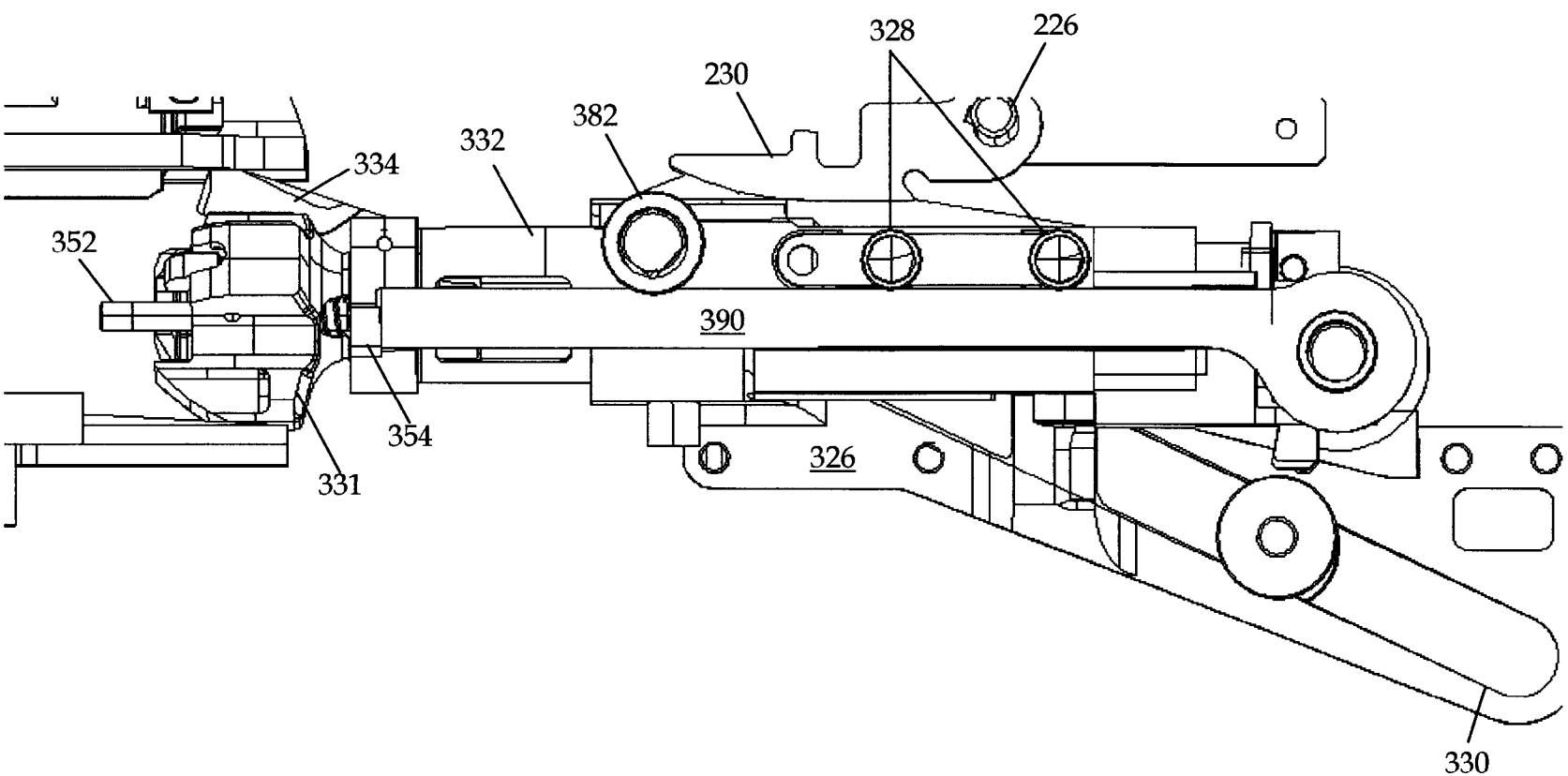
FIG. 10C illustrates the bolt carriage of the present invention.
Figure 11A:
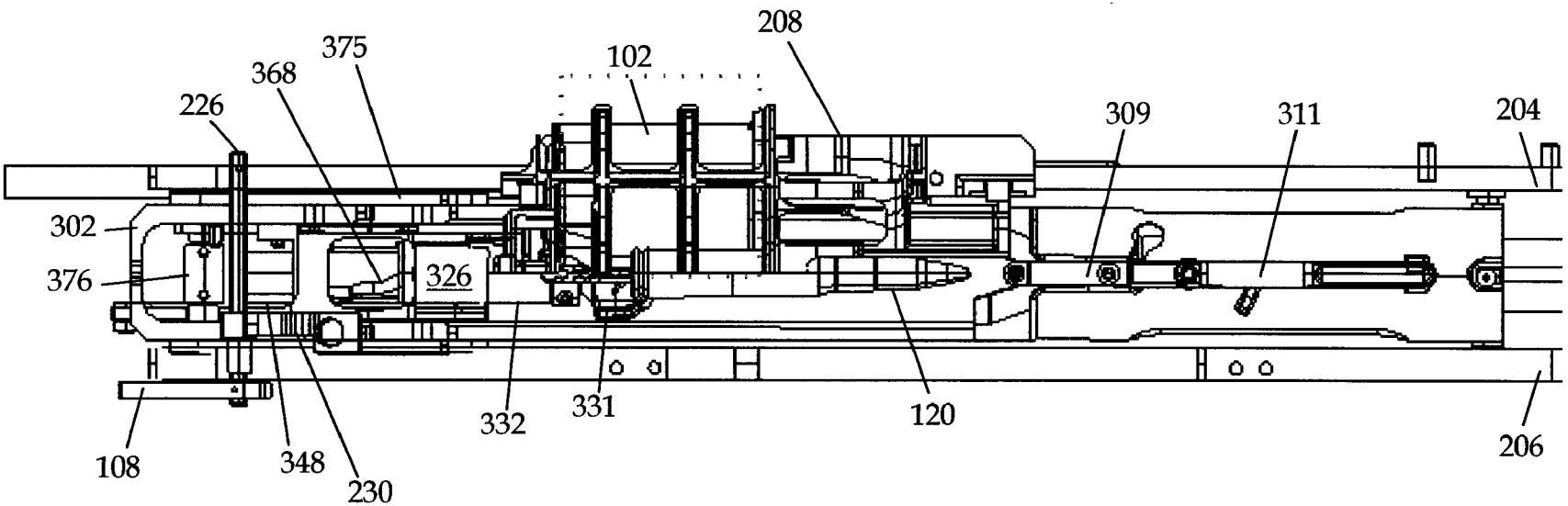
FIG. 11A is a top view of the operating group at the start of the firing cycle.
Figure 11B:
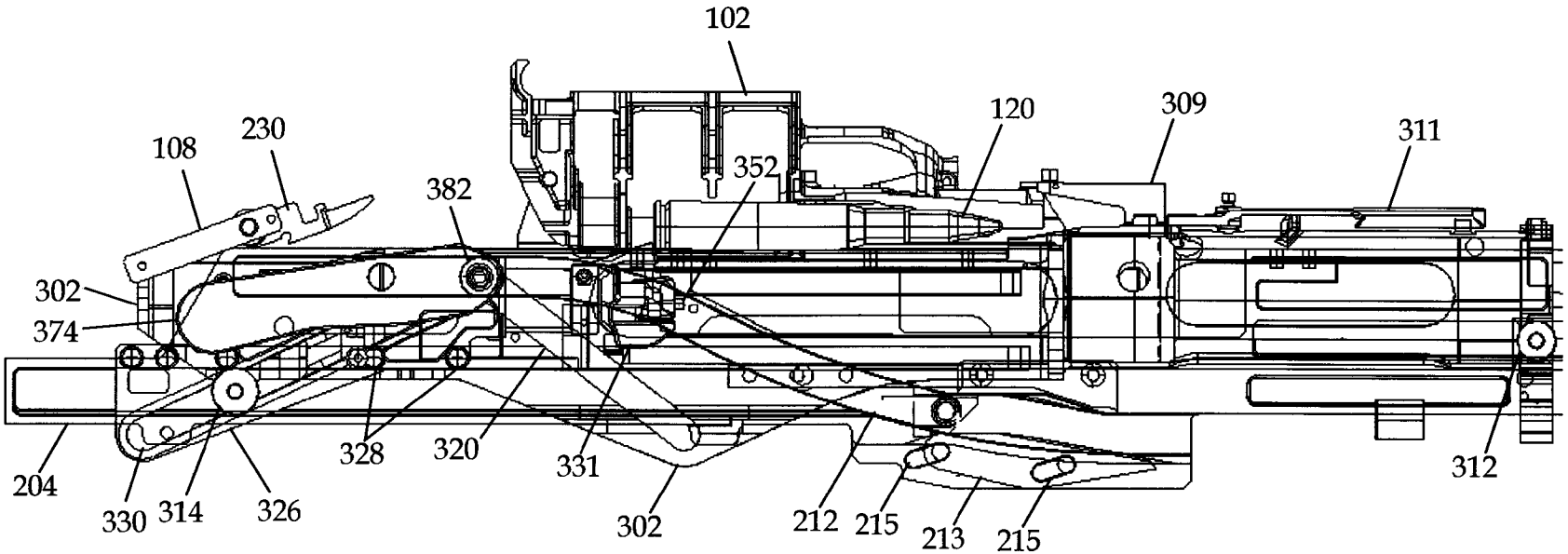
FIG. 11B is a cross-sectional view of the present invention showing the position of the rollers at the start of the firing cycle.

Referring to FIGS. 10A-10B, with the weapon 100 is charged with the barrel extension 302 located at the rear of the receiver 200 where it is held back by a hook on the sear 226 (see FIG. 11B). The bolt carriage 326 is positioned to the rear of the barrel extension 302 and held in place by the rollers 378, 380, 382 located at the top of their respective cam ways 330, 320, 212. The round ejector finger 352 extends forward of the bolt head 331 and is held in this position by the ejector stop post 354. A cartridge 110 is in the strip position in the cartridge guide 104.

With reference to FIG. 11, the operator initiates the firing sequence by carefully aiming the weapon system 100 and pulling the trigger 108. The trigger 108 moves the sear 226 out of the way, releasing the barrel extension 302, allowing the buffer main spring 402 to push the barrel extension 302 forward. The receiver roller 382 moves along the upper portion of the bimodal cam way 212. With the barrel extension 302 0.25 inches from the sear position, the rammer 334 engages the cartridge 110 and pushes it through a link (not shown).

Figure 12A:
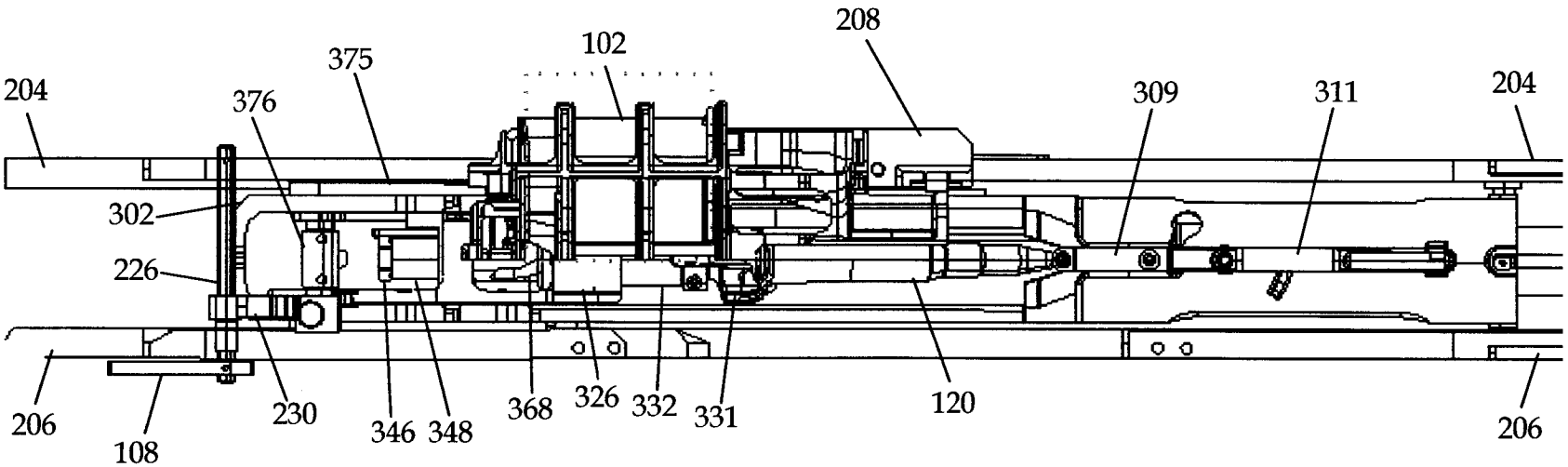
FIG. 12A is a top view of the operating group at a position of the firing cycle.
Figure 12B:
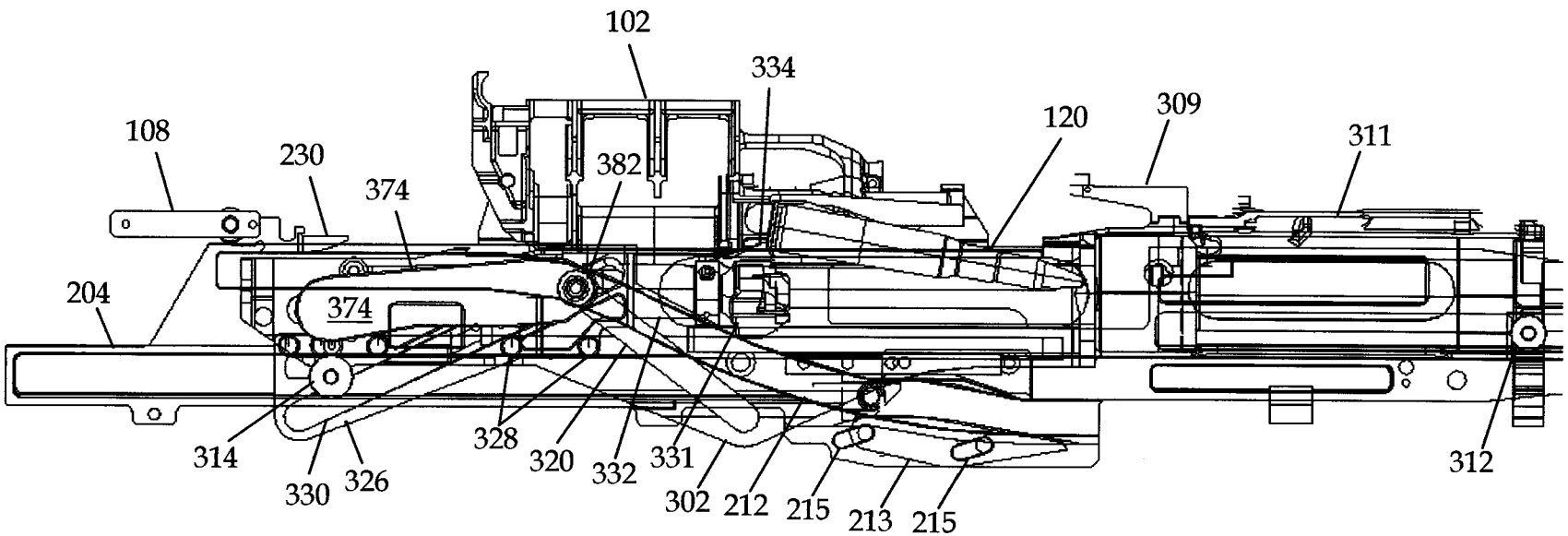
FIG. 12B is a cross-sectional view of the present invention showing the position of the rollers at a position of the firing cycle.
Figure 12C:
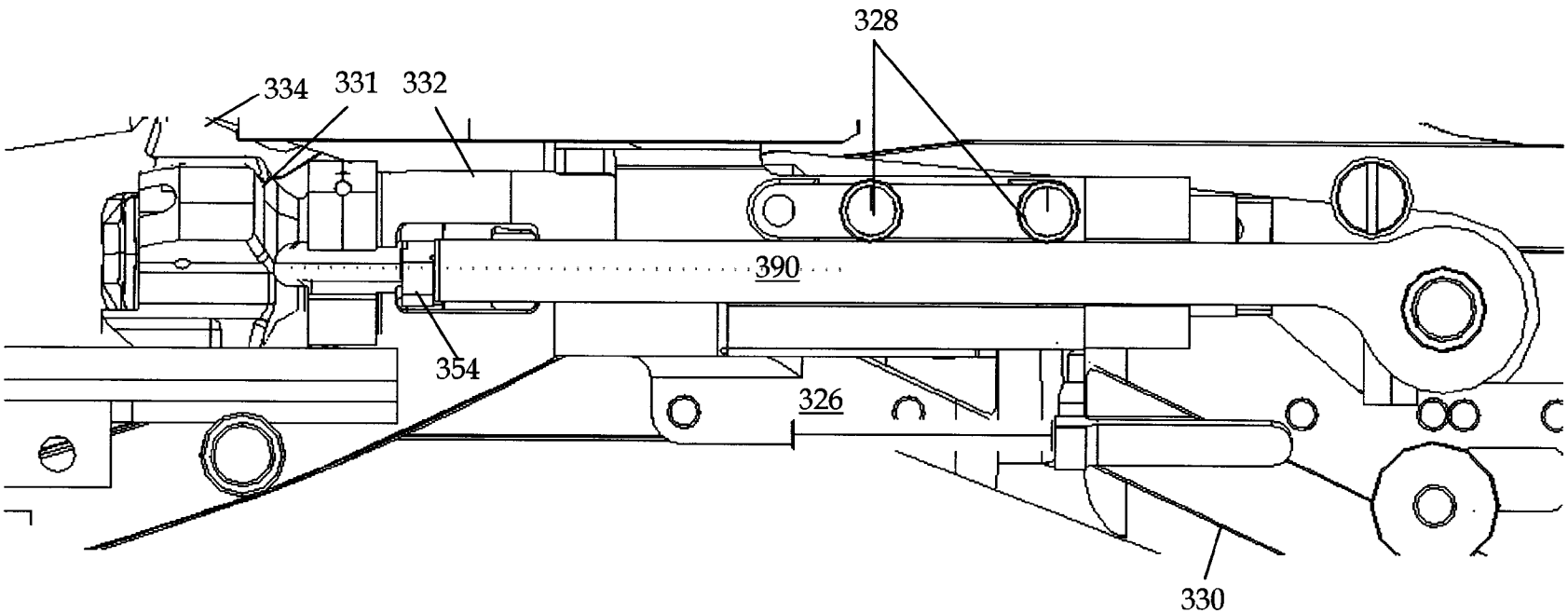
FIG. 12C is a cross-sectional view showing the bolt assembly stripping the round from the link with the rammer.

Referring now to FIGS. 12A-12C, the barrel extension 302 continues forward, the receiver roller 382 enters the downward sloping portions of the bimodal cam way 212, pushing the receiver roller 382, barrel extension roller 380, and carriage roller 378 through a downward changing slope. Moving through the changing slope, the barrel extension roller 380 begins to move downward and decelerate the barrel extension 302. At the same time, the carriage roller 378 pushes on the carriage cam way 330 to increase the carriage 326 acceleration relative to that of the barrel extension 302. With the barrel extension 302 2.57 inches from the sear position, the rammer 334 to begins to push the cartridge 110 into the barrel chamber 305. At 3.1 inches from the sear position, the bolt assembly 306 and bolt carriage 326 have traveled farther than the ejector bar 390. This relieves the ejector stop 354 of the ejector bar 390 and allows the ejector spring 340 to push the ejector 338 rearward, clearing the ejector from the bolt face 329.

Figure 13A:
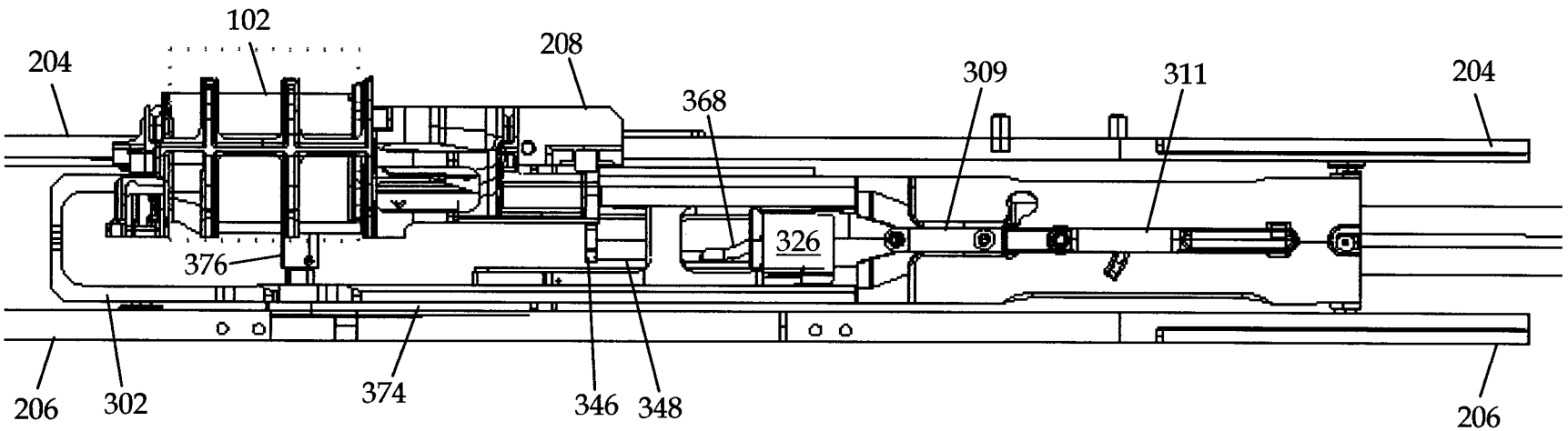
FIG. 13A is a top view of the operating group closing the chamber.
Figure 13B:
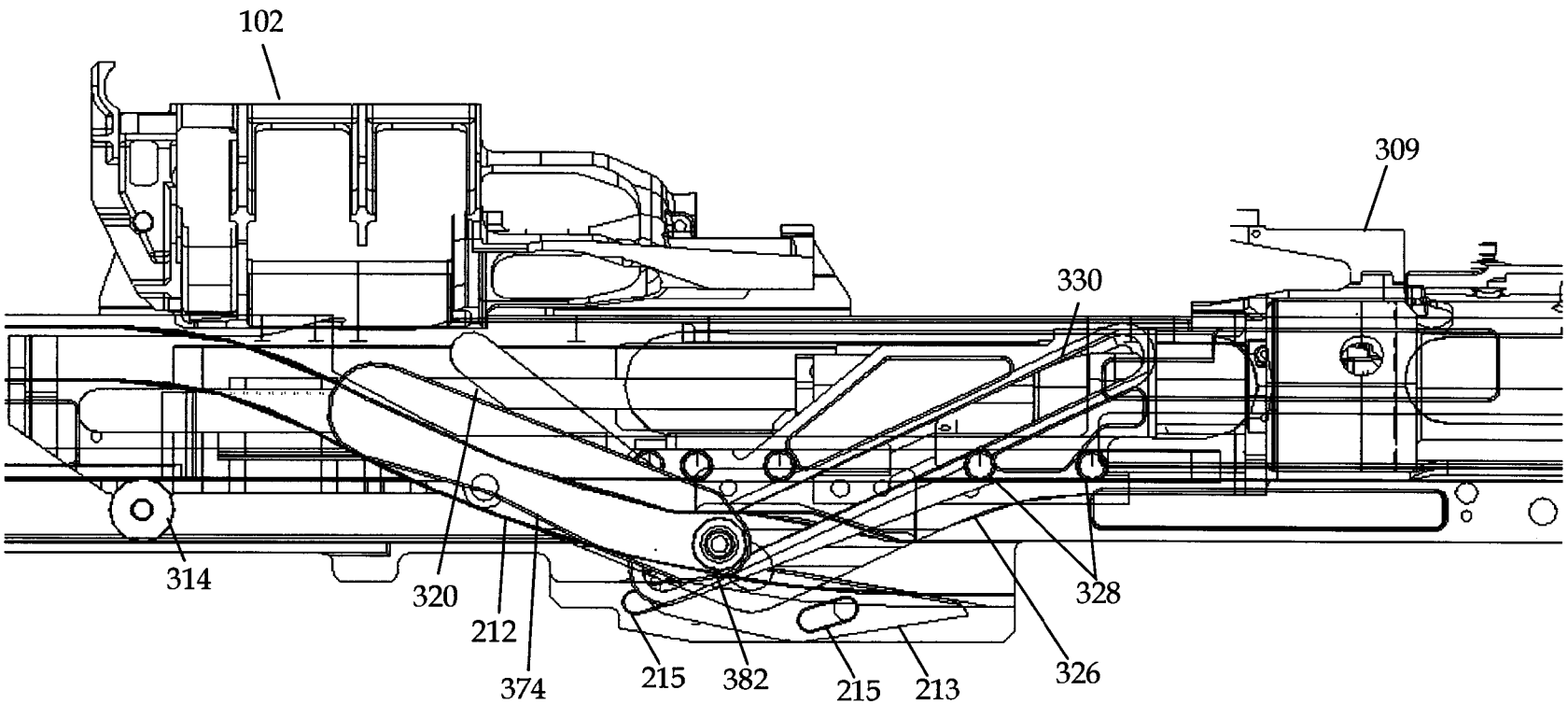
FIG. 13B is a cross-sectional view of the present invention showing the position of the rollers when the chamber is closed.

With reference now to FIGS. 13A and 13B, the barrel extension 302 continues forward with enough momentum to drive the ammunition feeder 102, which indexes the next cartridge into position. Such feed systems are generally known in the art, such as, for example, that disclosed by U.S. Pat. No. 6,343,536, which is incorporated herein by reference. As the barrel extension 302 continues forward, the receiver roller 382 moves through the relieved portion of the bimodal cam way (see FIG. 13B). The carriage 326 is slowed down relative to the receiver and barrel extension and the receiver roller 382 is forced to the upper surface of the bimodal cam by the active cam gate 213. With the barrel extension 7.2 inches from the sear position, the bolt head 331 closes the chamber 305 and its forward motion stops. As the chamber 305 closes, the forward motion of the ammunition round 110 is stopped by the barrel and it is forced into the round extractor 336. The carriage 326 however continues forward relative to the bolt 332. Moving forward, the carriage 326 pushes the firing pin forward, which cause the bolt cam pin 344 to move through the bolt cams 368 forcing the bolt 332 to rotate clockwise.

Figure 14A:
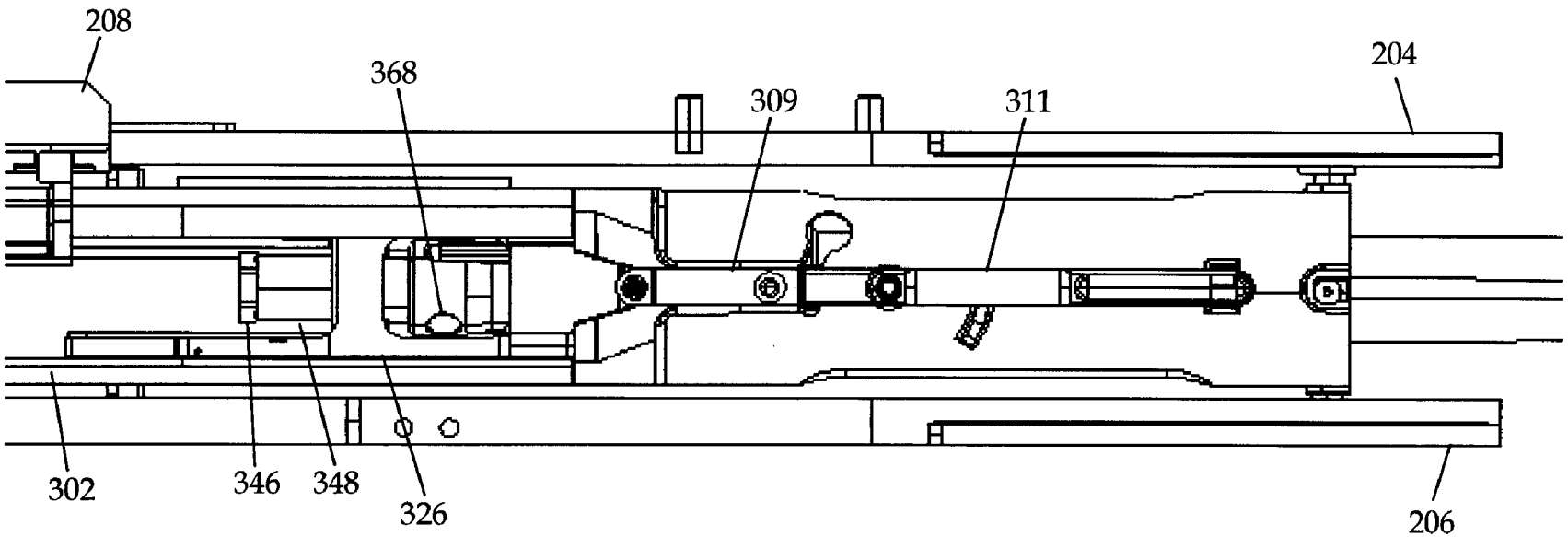
FIG. 14A is a top view of the operating group with the firing pin contacting the round.
Figure 14B:
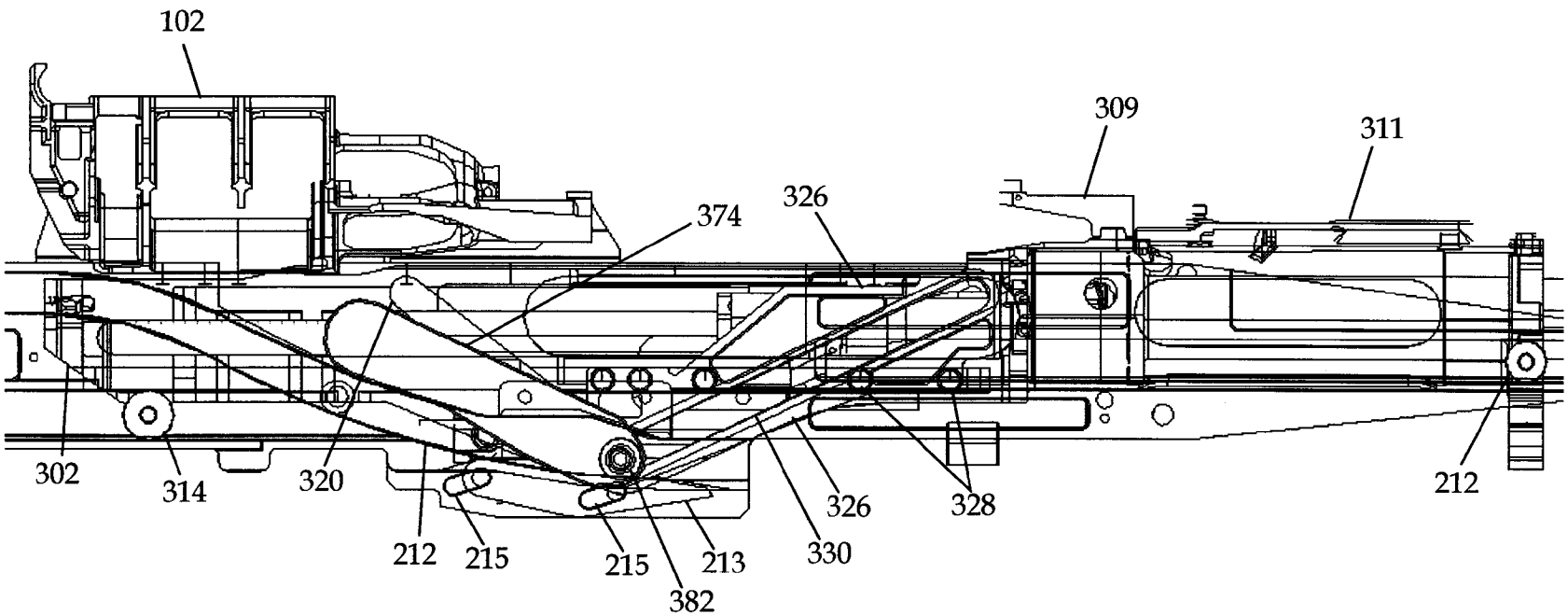
FIG. 14B is a cross-sectional view showing the position of the rollers when the firing pin contacts the round.
Figure 15A:
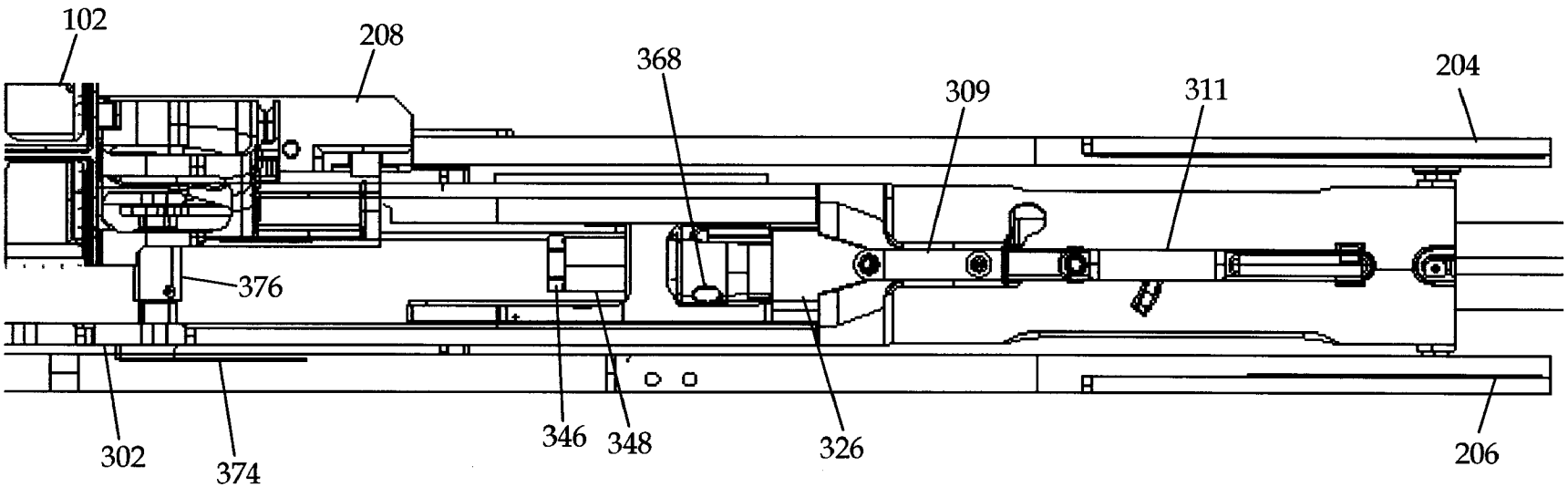
FIG. 15A is a top view of the operating group at the start of recoil.
Figure 15B:
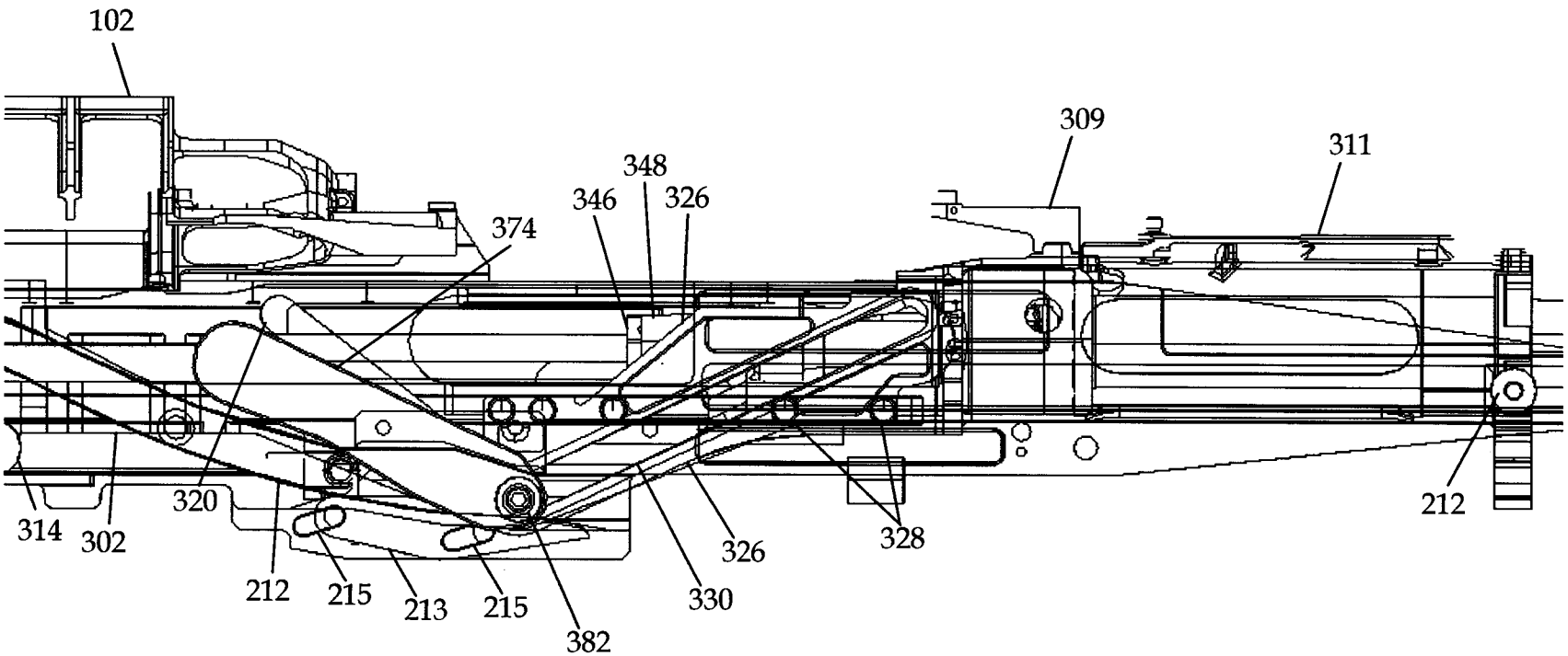
FIG. 15B is a cross-sectional view showing the position of rollers at the start of recoil.

Referring now to FIGS. 14A and 14B, the barrel extension 302 continues forward, driving the receiver roller 382 farther through the bimodal cam 212, accelerating the carriage 326. The firing pin assembly 342 continues forward, rotating the bolt 332 until it locks with the chamber 305. With the barrel extension 8.0 inches from the sear position, the carriage 326 drives the firing pin 343 into the cartridge primer, causing the propulsion train to ignite and push the bullet out of the barrel 304. At this time, the barrel extension 302 forward movement is stopped and it is driven rearward from the impulse of the fired round.

Referring now to FIGS. 15A-16C, the unlocking of the bolt will now be explained. Due to the impulse of the fired round, the barrel extension 302 moves rearward, driving the receiver roller 382 into the lower surface of the bimodal cam 212. The carriage 326 then accelerates rearward by the receiver roller 382 moving through the upward slope of the bimodal cam 212 (see FIG. 16B). At the same time, the barrel extension rollers 380 and carriage roller 378 move upward in their respective cam ways 330, 320. As the carriage 326 moves rearward, the bolt 332 is initially still held in the chamber 305 as the cam pin 344 moves through the straight portion of the bolt cam 368. When the carriage 326 proceeds farther rearward, the cam pin 344 enters the helical portion of the bolt cam 368 and the bolt 332 rotates counterclockwise and is unlocked from the chamber 305 and pulled rearward by the carriage 326.

Figure 16A:
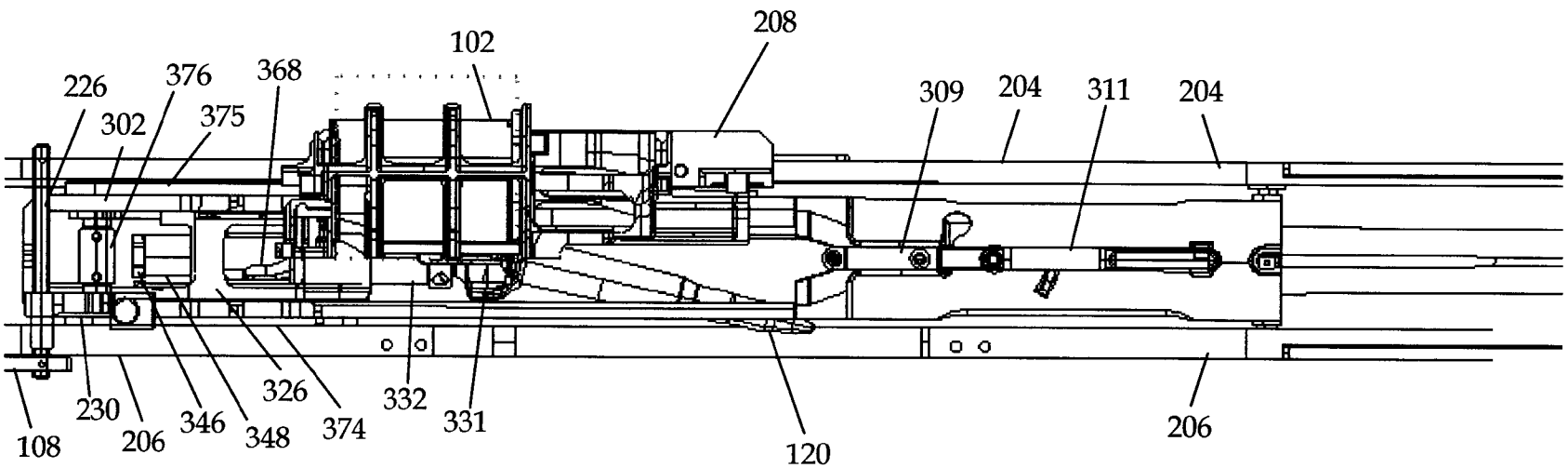
FIG. 16A is a top view of the operating group ejecting a spent cartridge.
Figure 16B:
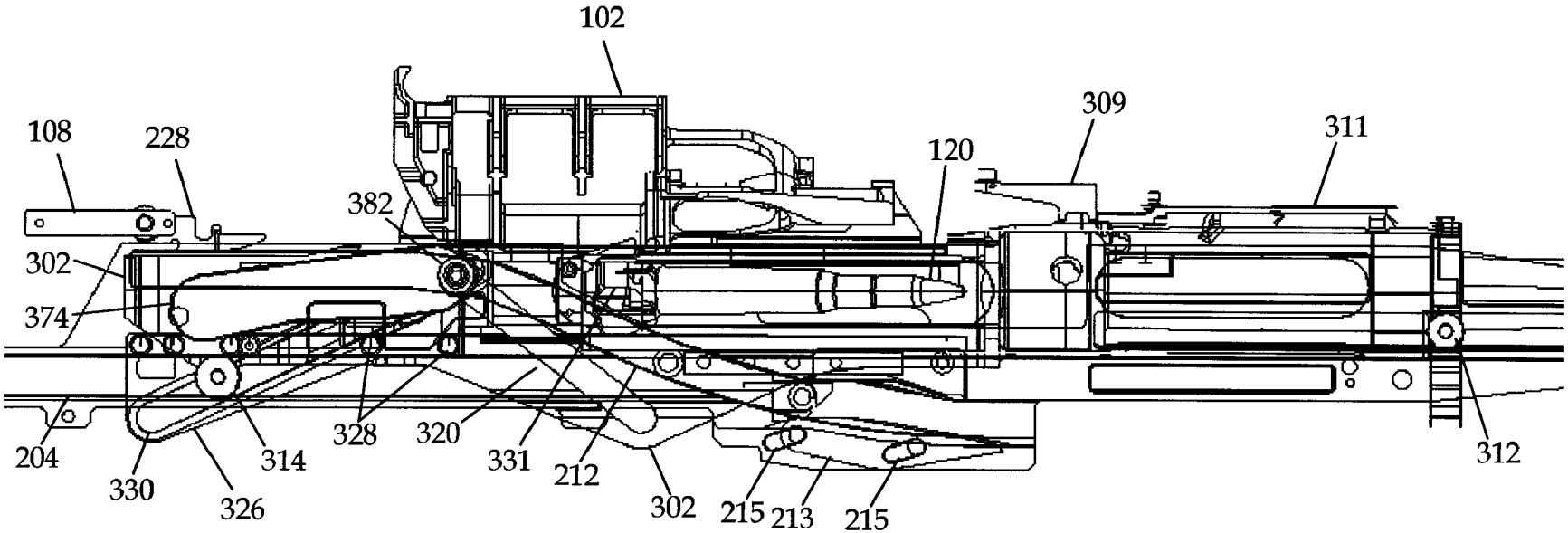
FIG. 16B is a cross-sectional view showing the position of the rollers when a spent cartridge is ejected.
Figure 16C:
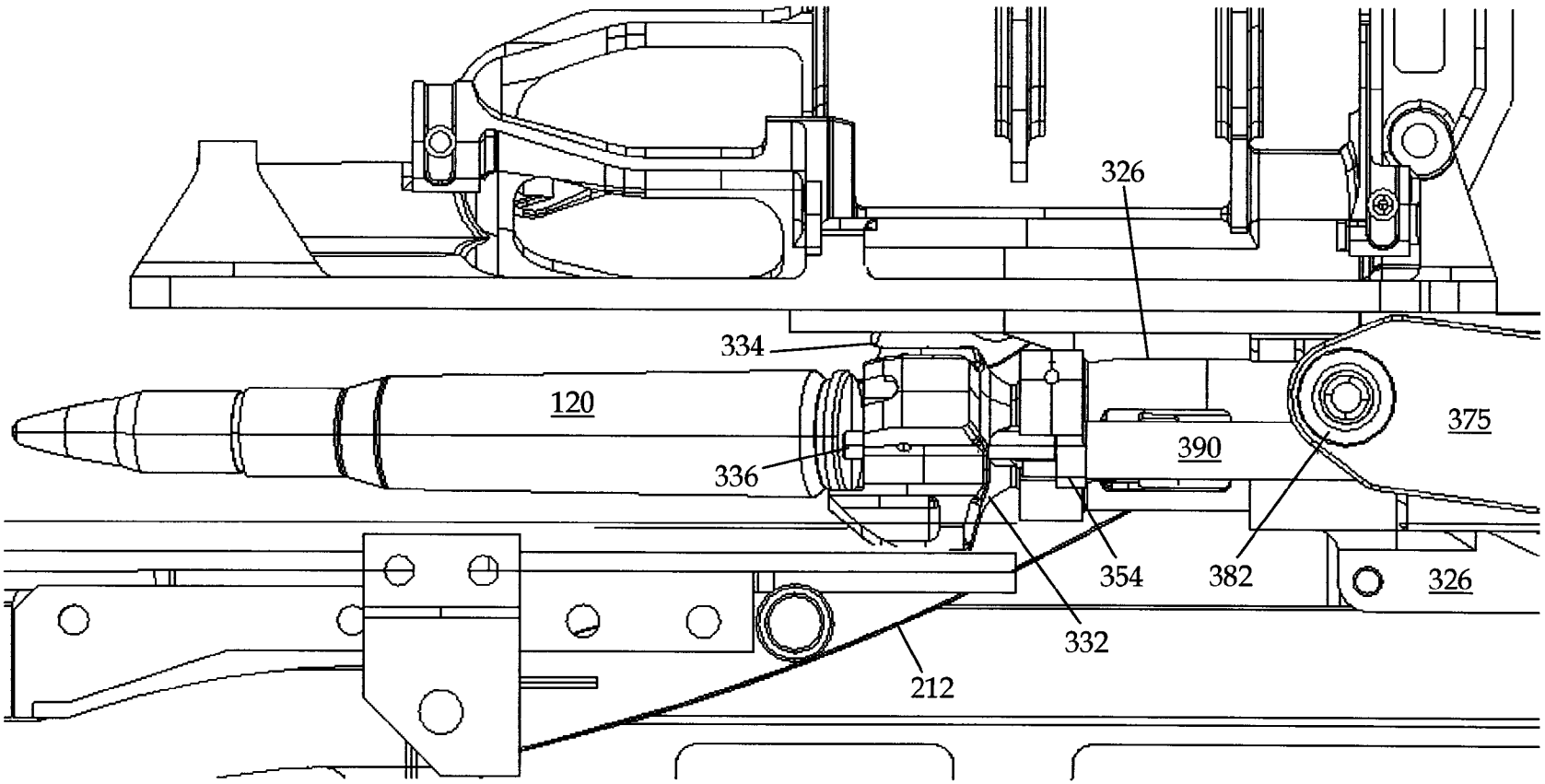
FIG. 16C is a cross-sectional view showing the bolt assembly ejecting the round after firing.

With reference to FIGS. 16A-16C, the barrel extension 302 continues rearward driving the rollers 378, 380, 382 upward and along their respective cam ways 330, 320, 212. The forward claw-like edge 357 of the round extractor 336 grips the rim of the cartridge 110 and pulls the cartridge 110 out of the chamber 305. The receiver roller now enters the upward sloped portion of the bimodal cam 212 and decelerates the rearward moving carriage 326. The ejector stop post 354 then engages the ejector stop 354 (See FIG. 16C) causing the ejector finger 352 to extend forward of the bolt head 331, impacting the back of the cartridge 110 near its circumferential edge, pushing the cartridge 110 off the bolt head 331 and out of the grip of the round extractor 336 and rotating the cartridge 110 laterally clear of the weapon through the eject port 106.

The barrel extension 302 continues rearward driving the receiver roller 382 into top portion of the bimodal cam 212 to sear the carriage 326. The barrel extension 302 continues rearward until the buffer assembly 400 stops it. The barrel extension 302 will then sear up or continue forward to repeat the firing cycle, depending on the operating mode and the orientation of the trigger 108. The sear position is illustrated in FIGS. 10A and 10B.

While the firing cycle has been described at 7 discrete points relating to FIGS. 10A-16B, these 7 discrete positions have been described merely for illustrative purposes only. It should be understood that, in operation, the present invention's firing cycle comprises a smooth and continuous sequence of motion, taking the operating group 300 from sear position, to firing the round, and back to sear position.

Other embodiments of the invention will be apparent to those skilled in the art from consideration of the specification and practice of the invention disclosed herein. It is intended that the specification be considered as exemplary only, with a true scope and spirit of the invention being indicated by the following claims.

The invention claimed is:

1. A weapon system comprising:

a receiver having at least one side plate with a bimodal cam way formed therein;

the bimodal cam having an upper surface and a lower surface;

a barrel extension having at least a first end and at least one side plate, a cam way formed into the at least one side;

a barrel having a longitudinal axis and mounted to the barrel extension first end;

a spring and buffer assembly with a first end and a second end, wherein the first end is mounted to the barrel extension and the second end is mounted to the receiver, the mounted spring and buffer assembly being generally parallel to the barrel longitudinal axis;

a bolt carriage having a first end, a second end and at least one side plate, with a carriage cam way formed in the side plate;

a firing pin assembly fixed to the bolt carriage and having a bolt cam way;

a rotary lock bolt having a first end, a second end, and a hollow pass-through, wherein the first end comprises a generally flat forward facing surface and a plurality of lugs radially arranged about the forward facing surface;

the hollow pass-through extends through both first and second ends, and is shaped to telescopically receive the firing pin assembly;

a bolt cam pin adapted to be fixedly attached to the rotary lock bolt and simultaneously capable of sliding in and along the firing pin assembly bolt cam way;

wherein relative movement along the longitudinal axis between the firing pin assembly and the rotary lock bolt causes the rotary lock bolt to rotate about the longitudinal axis due to the bolt cam pin riding in the bolt cam way;

a toggle assembly having a toggle arm, a carriage cam way roller that rides in the carriage cam way, a barrel extension cam way roller that rides in the barrel extension cam way, and a receiver bimodal cam way roller to ride in the receiver bimodal cam way, the carriage cam way roller, barrel extension cam way roller and receiver cam way roller being collinear;

wherein the receiver roller rides on at least a portion of the bimodal cam way upper surface during a forward stroke of a firing cycle of the weapon system; and wherein the receiver roller rides on at least a portion of the bimodal cam way lower surface during a rearward recoil stroke of a firing cycle of the weapon system.

2. The weapon system of claim 1, wherein:

wherein the bolt carriage rides in the barrel extension along a path parallel to the longitudinal axis.

3. The weapon system of claim 1, wherein:

wherein the firing pin assembly has a firing pin extending from a first end and adapted to slide through the rotary lock bolt hollow pass-through and extend beyond the rotary lock bolt forward facing surface.

4. The weapon system of claim 1, wherein:

wherein the firing pin assembly is supported by the bolt carriage and the bolt telescopically receives and is supported by the firing pin assembly, a pin is rotationally fixed to the bolt about the longitudinal axis and rides in the bolt cam.

5. The weapon system of claim 1, wherein:

as the vertical position of the receiver roller changes, the horizontal position of the carriage relative to the barrel extension changes.

6. The weapon system of claim 1, wherein:

the bolt comprises a cartridge ejector that spring loaded to extend beyond a forward face of the bolt, and is selectively retractable to be clear of the forward face of the bolt.

7. The weapon system of claim 1, wherein:

the bolt comprises a spring-loaded cartridge retainer.

* * * * *